US009879372B2

(12) United States Patent
Wakizaka et al.

(10) Patent No.: US 9,879,372 B2
(45) Date of Patent: Jan. 30, 2018

(54) CLOTHES DRYER

(71) Applicant: SAMSUNG ELECTRONICS CO., LTD., Suwon-si, Gyeonggi-do (KR)

(72) Inventors: Eiji Wakizaka, Osakabu (JP); Tomohito Ajiki, Osakabu (JP); Yuji Eifuku, Osakabu (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 683 days.

(21) Appl. No.: 14/307,785

(22) Filed: Jun. 18, 2014

(65) Prior Publication Data

US 2014/0366397 A1 Dec. 18, 2014

(30) Foreign Application Priority Data

| | | |
|---|---|---|
| Jun. 18, 2013 | (JP) | 2013-127658 |
| Jun. 18, 2013 | (JP) | 2013-127674 |
| Feb. 5, 2014 | (JP) | 2014-020639 |
| Jun. 16, 2014 | (KR) | 10-2014-0072519 |

(51) Int. Cl.

| | |
|---|---|
| ***D06F 58/28*** | (2006.01) |
| ***D06F 58/20*** | (2006.01) |
| ***D06F 58/02*** | (2006.01) |

(52) U.S. Cl.

CPC ..... *D06F 58/206* (2013.01); *D06F 58/02* (2013.01); *D06F 58/28* (2013.01); *D06F 2058/287* (2013.01); *D06F 2058/2864* (2013.01)

(58) Field of Classification Search

CPC ..... D06F 58/206; D06F 58/28; D06F 58/02; D06F 2058/287; D06F 2058/2864

See application file for complete search history.

(56) References Cited

U.S. PATENT DOCUMENTS

| | | | | |
|---|---|---|---|---|
| 2012/0144693 | A1* | 6/2012 | Wakizaka | D06F 58/206 34/492 |
| 2012/0186305 | A1* | 7/2012 | Taniguchi | D06F 25/00 68/19 |

FOREIGN PATENT DOCUMENTS

| | | | |
|---|---|---|---|
| JP | 02212770 | A * | 8/1990 |
| JP | 5-133972 | | 5/1993 |
| JP | 6-317441 | | 11/1994 |
| JP | 2002-233696 | | 8/2002 |
| JP | 2008-79767 | | 4/2008 |
| JP | 2008-86693 | | 4/2008 |
| KR | 20-1996-037542 | | 12/1996 |
| KR | 10-2006-0038859 | | 5/2006 |
| KR | 10-2012-0017607 | | 2/2012 |

* cited by examiner

*Primary Examiner* — Jessica Yuen
(74) *Attorney, Agent, or Firm* — Staas & Halsey LLP

(57) ABSTRACT

A clothes dryer configured to cause air to flow through a drying chamber, an exhaust passage (an air passage) 103 and a filter by a blower to dry clothes includes a heat pump installed in the exhaust passage (103) and having a heat exchanger (122) including a refrigerant pipe (132) and a pin, and a flow velocity sensor (107) of airflow having a hot thermistor (a heat generating body) 107*a* and a temperature compensation thermistor (a temperature detecting body) 107*b* and installed downstream from the heat exchanger (122), wherein the thermistors (107*a* and 107*b*) are disposed at a refrigerant pipe (132) of the heat exchanger (122) in parallel.

22 Claims, 39 Drawing Sheets

CLOTHES DRYER

CROSS-REFERENCE TO RELATED APPLICATION

This application claims the benefit of Japanese Patent Application No. 2013-127658, filed on Jun. 18, 2013, Japanese Patent Application No. 2013-127674, filed on Jun. 18, 2013, Japanese Patent Application No. 2014-020639, filed on Feb. 5, 2014 in the Japanese Patent Office and Korean Patent Application No. 10-2014-0072519, filed on Jun. 16, 2014 in the Korean Intellectual Property Office, the disclosure of which is incorporated herein by reference.

BACKGROUND

1. Field

Embodiments of the present invention relate to a clothes dryer having a heat pump.

2. Description of the Related Art

For example, in a rotary drum type clothes dryer, a filter is installed in an exhaust path for wet air discharged from clothes. In addition, a detection unit is configured to detect clogging of the filter and emit an alarm or the like when clogging is detected. For example, a differential pressure sensor configured to detect a pressure difference upstream and downstream from a heat exchanger is known to be used as the detection unit. That is, it is determined that filter clogging is generated when the pressure difference is a predetermined level or less according to reduction in flow rate of the passing air (for example, see Patent Literature 1).

In addition, in general, as a sensor configured to detect a flow velocity or a flow direction of fluid (a gas), there is a sensor including a center main column installed at a center of a base, two temperature compensation thermistors installed in parallel on an upper end surface of the center main column, side main columns installed with the center main column interposed therebetween and having a height smaller than that of the center main column, and flow velocity sensors mounted on upper end surfaces of each of the side main columns to react with heat taken by the fluid to detect a flow velocity (for example, see Patent Literature 2).

In addition, among sensors (anemometers) configured to detect a flow velocity of such a gas, there is a sensor having a sensor unit configured to measure a wind velocity and surrounded by a cylindrical rectification member.

For example, in Patent Literature 3, an airflow meter installed at a suction path of an engine is disclosed, and the airflow meter is constituted by a heat generating resistor disposed at a cylindrical subsidiary passage or in the inside thereof, a thermosensitive resistor for temperature compensation, and so on.

However, when the differential pressure sensor is used as described above, a pipe communicating between an air passage and differential pressure sensor should be provided. For this reason, a structure thereof may be complicated and manufacturing cost may be increased.

In addition, the inventor(s) has attempted to apply a sensor configured to react with heat taken by fluid to detect a flow velocity as disclosed in Patent Literature 2 to a clothes dryer for filter clogging detection. However, the filter clogging cannot be precisely detected due to many detection errors.

In addition, a lint filter should be detached and attached when cleaned. When the lint filter is imperfectly mounted, a gap may be generated and lint may intrude into the exhaust path. Accordingly, when the above-mentioned anemometer is used in the clothes dryer, the lint may be caught by the rectification member to cause unstable measurement. The lint caught by the rectification member should be manually removed. Accordingly, on all such occasions, the dryer should be disassembled and the anemometer should be taken out, thus requiring a complex operation.

In addition, as a conventional heat pump type clothes dryer, there is provided a clothes dryer shown in FIG. 36. In the clothes dryer, air suctioned into the suction flow path to be suctioned into the drum configured to accommodate clothes is heated in a condenser (a radiator) and an auxiliary heater. Further, there is an exhaust-type heat pump dryer configured to evaporate moisture of clothes in a drum, collect heat from air having a high temperature and high humidity exiting the drum by an evaporator (a thermal absorber) installed at an exhaust flow path, and exhaust the air.

In order to reduce a drying time using the exhaust-type heat pump dryer, a heating capacity of the suction flow path should be increased, and a heat collecting amount of a thermal absorber should be increased for the sake of thermal efficiency.

However, when a large capacity compressor is applied to the exhaust-type heat pump dryer according to a standard condition, a refrigerant temperature or a refrigerant pressure in a heat pump circuit is increased to heat the suctioned refrigerant to a high temperature and thus increase a compressor temperature when operated under an overload condition such as when an external air temperature is high or a load is large. Accordingly, the compressor temperature may deviate from an allowable use range and the compressor may overheat or stop. In order to prevent these problems, use of the large capacity compressor should be avoided and a compressor capacity should be reduced. However, in this case, a capacity of the heat pump is decreased and a drying time upon normal operation is also increased.

While not provided in the exhaust-type heat pump dryer, as a countermeasure of the high temperature and high pressure of the refrigerant in the circulation type heat pump dryer, as disclosed in Patent Literature 4, there is a method of decreasing a refrigerant temperature of a heat pump circuit by providing an auxiliary condenser in addition to a heat exchange stove in a circulation type heat pump circuit and radiating heat from the auxiliary condenser to the outside of the heat exchange stove. However, in order to efficiently radiate the heat to the outside of the heat exchange stove, an exclusive blower configured to blow air should be installed at the auxiliary condenser, which may cause an increase in size or cost of an apparatus.

In addition, while a method of cooling the auxiliary condenser using drained water may be employed to improve radiation efficiency, when the water cooling is performed, the heated drained water is evaporated, causing dew condensation in the housing or an increase in temperature and humidity therearound.

FIG. 37 shows a configuration in which an auxiliary condenser is provided in addition to the heat exchange stove of the conventional exhaust-type heat pump dryer. However, in such a configuration, similarly, in addition to the heat exchange stove, an exclusive blower configured to blow air to the auxiliary condenser is required to efficiently radiate heat, which may cause an increase in size or cost of the apparatus. In addition, when the auxiliary condenser is cooled using water such as the drained water or the like, the temperature of the drained water that absorbs heat may be increased and cause dew condensation in the housing or an increase in temperature and humidity.

In addition, in the above-mentioned exhaust-type heat pump clothes dryer, when the external air temperature is low, the refrigerant temperature and the refrigerant pressure in the heat pump circuit are decreased to decrease the temperature of the refrigerant introduced into evaporator, generating frost on the evaporator. When the frost is generated, the evaporator may become clogged.

In order to solve these problems, there is provided a method by which a compressor capacity can be reduced and a decrease in temperature of the refrigerant to a temperature below zero can be prevented even when low temperatures are used. However, when the compressor capacity is reduced, a drying capacity under the standard condition (the normal temperature) may be decreased.

In addition, as another method, there is a method of increasing a capacity of an evaporator or a method of employing a variable displacement compressor such as an inverter or the like. However, when generation of the frost is prevented by only an increase in evaporator capacity or the variable displacement compressor is employed, cost may be increased.

In addition, while not provided in the exhaust-type heat pump clothes dryer, as a countermeasure of the frost generated on the thermal absorber in the circulation type heat pump clothes dryer, as disclosed in Patent Literature 5, a high pressure pipe configured to heat the thermal absorber through a portion of the thermal absorber upstream from a decompression unit using a high pressure refrigerant supplied from a radiator disposed upstream from the refrigerant circuit is provided.

However, in the method disclosed in Patent Literature 5, the thermal absorber itself is heated but the temperature of the refrigerant introduced into the thermal absorber is not increased. Accordingly, when the external air temperature is low, the problem such as the decrease in temperature of the refrigerant introduced into the thermal absorber cannot be solved.

CITATION LIST

Patent Literature (Patent Literature 1) Japanese Unexamined Patent Application, First Publication No. 2002-233696

(Patent Literature 2) Japanese Unexamined Patent Application, First Publication No. H05-133972

(Patent Literature 3) Japanese Unexamined Patent Application, First Publication No. H06-317441

(Patent Literature 4) Japanese Unexamined Patent Application, First Publication No. 2008-79767

(Patent Literature 5) Japanese Unexamined Patent Application, First Publication No. 2008-86693

SUMMARY

In consideration of the above-mentioned problems, an object of the present invention is to provide a clothes dryer capable of precisely detecting a flow rate of airflow flowing through the clothes dryer with a relatively simple configuration.

In addition, another aspect of the present invention is to provide a clothes dryer capable of preventing lint from being hooked to an anemometer to improve reliability without performing a complex operation.

Further, in order to solve the problems by one effort, the present invention is directed to preventing a high temperature and a high pressure of a refrigerant of a heat pump circuit in an exhaust-type heat pump dryer and dew condensation in a housing or an increase in temperature and humidity therearound.

In addition, the present invention is directed to preventing frost from being generated on an evaporator in a low temperature and low pressure state of a refrigerant in a heat pump circuit without enhancement of an evaporator capacity or reduction in compressor capacity of an exhaust-type heat pump clothes dryer and without using a variable displacement compressor.

Additional aspects of the invention will be set forth in part in the description which follows and, in part, will be obvious from the description, or may be learned by practice of the invention.

In accordance with a first aspect of the present invention, there is provided a clothes dryer configured to cause air to flow through a drying chamber, an air passage and a filter by a blower to dry clothes, the clothes dryer includes a heat pump having a heat exchanger installed in the air passage and including a refrigerant pipe and a pin; and a flow velocity sensor having a heat generating body and a temperature detecting body, installed downstream from the heat exchanger and configured to detect a flow velocity of airflow, wherein the heat generating body and the temperature detecting body of the flow velocity sensor are disposed at the refrigerant pipe of the heat exchanger in parallel.

Accordingly, since a temperature of the airflow flowing at positions of the heat generating body and the temperature detecting body of the flow velocity sensor is substantially similarly varied during starting of an operation of the clothes dryer, a flow velocity or an air volume of the airflow can be precisely detected with a relatively simple configuration even when the clothes dryer is not operating normally. In addition, since an air stream is stabilized by a rectification effect of the pin, detection is more precisely performed.

According to a second aspect of the present invention, in the clothes dryer of the first aspect, the heat exchanger may be installed downstream from the drying chamber.

Accordingly, a relatively low airflow temperature can be detected to detect the flow velocity or the air volume of the airflow.

According to a third aspect of the present invention, in the clothes dryer of the second aspect, the heat exchanger may be an evaporator of a refrigerant.

Accordingly, in particular, even when the temperature of the airflow passing through the evaporator is varied upon starting of the operation of the clothes dryer, the flow velocity of the airflow can be precisely detected.

According to a fourth aspect of the present invention, in the clothes dryer of the second aspect, the heat pump may include a first condenser of the refrigerant installed upstream from the drying chamber, an evaporator of the refrigerant installed downstream from the drying chamber, and a second condenser connected to the first condenser in parallel and installed downstream from the evaporator, and the heat exchanger may be the second condenser.

Accordingly, as an operation of the second condenser is turned ON/OFF, even when the airflow temperature is varied, the flow velocity of the airflow can be precisely detected.

According to a fifth aspect of the present invention, in the clothes dryer of any one of the first to fourth aspects, the heat generating body and the temperature detecting body are disposed at the refrigerant pipe in parallel with precision of ½ or less of a pitch of the refrigerant pipe.

Accordingly, the flow velocity of the airflow can be relatively precisely detected while facilitating an attachment operation of the heat generating body or the temperature detecting body.

According to a sixth aspect of the present invention, the clothes dryer of any one of the first to fifth aspect may further include a detection unit configured to detect the filter clogging according to output of the flow velocity sensor.

Accordingly, since the flow velocity of the airflow is precisely detected as described above, the filter clogging can be more accurately detected.

For example, the flow velocity sensor has a cylindrical rectification unit, and a sensor unit protruding toward the inside of the rectification unit. In addition, a portion of the rectification unit is divided, and a slit extending in an airflow direction is formed in the rectification unit.

According to the clothes dryer, since the portion of the rectification unit of flow velocity sensor is divided and the slit extending in the airflow direction is formed, even when lint is hooked by the rectification unit, the lint can be discharged through the slit.

Specifically, the flow velocity sensor may further include a base section configured to support the sensor unit and the rectification unit and mounted on the air passage. In addition, the slit may be formed at a position opposite to the base section.

As a result, the slit is disposed at a position farthest from the base section at which the sensor unit is disposed so that the air stream in contact with the sensor unit is not largely scattered, and the rectification unit is bilaterally symmetrical with respect to the slit so that discharge of the lint is not deviated. Accordingly, the lint can be discharged with balance in a state in which an inherent function of the rectification unit is secured.

More specifically, a periphery of the rectification unit disposed at the upwind side may be inclined toward the downwind side from the base section to the slit.

As a result, the lint hooked by the rectification unit is gathered at the slit by the wind pressure to be automatically discharged from the rectification unit. Accordingly, a removal operation of the line is not needed.

In addition, the sensor unit may be inclined toward the downwind side from a bottom portion to a protrusion end.

As a result, the lint hooking to the sensor unit can be suppressed.

For example, the slit width may be gradually reduced from the upwind side toward the downwind side.

As a result, since the air stream in the slit becomes faster at the downwind side than at the upwind side, the lint can be easily pulled into the slit to accelerate the discharge of the lint.

In addition, a guide surface disposed in front of the rectification unit and inclined toward the downwind side from the mounting portion to the rectification unit may be formed at the upwind side of the base section.

As a result, the air in contact with the guide surface flows toward the rectification unit in an inclined direction, and the air stream flowing toward the front of the sensor unit in the inclined direction is formed. The air stream prevents the lint from being directed toward the sensor unit so that the lint is not hooked by the sensor unit.

For example, a minimum width of the slit may be set to 5 mm or less.

As a result, the lint can be discharged from the rectification unit without reducing a function of the rectification unit.

In addition, a clothes dryer according to the present invention includes a drum configured to accommodate clothes, a suction flow path configured to suction air into the drum, an exhaust flow path configured to exhaust the air from the drum, and a heat pump circuit having a compressor, a first condenser, a second condenser, a decompressor and an evaporator, in which the first condenser is disposed at the suction flow path, and the evaporator and the second condenser are disposed at the exhaust flow path.

As the second condenser is installed at the exhaust flow path, the second condenser exchanges heat with the exhaust air and the heat is radiated from the second condenser to cool the refrigerant of the heat pump circuit. Accordingly, the refrigerant temperature and the refrigerant pressure of the heat pump circuit can be decreased without necessity of blowing using an exclusive blower and an increase in size of the dryer. In addition, since there is no need for water cooling by the drained water, dew condensation in the housing or an increase in temperature and humidity around the housing due to the water cooling by the drained water can be prevented.

Here, in order to increase cooling efficiency of the heat pump circuit by independently cooling the refrigerant of the heat pump circuit using the second condenser, the heat pump circuit may have a main circuit to which the compressor, the first condenser, the decompressor and the evaporator are sequentially connected, and a sub-circuit branched off between the compressor and the first condenser of the main circuit, including the second condenser, and joining the first condenser and the decompressor.

In order to adjust the refrigerant temperature and the refrigerant pressure of the heat pump circuit to a desired value, a refrigerant flow rate regulator may be installed upstream or downstream from the second condenser of the sub-circuit. In this case, since a heating value of the second condenser can be adjusted by increasing or decreasing the amount of the refrigerant introduced into the sub-circuit, the refrigerant temperature and the refrigerant pressure of the heat pump circuit can be adjusted to a desired value.

In addition, as another configuration, in order to adjust the refrigerant temperature and the refrigerant pressure of the heat pump circuit, the heat pump circuit may have a main circuit to which the compressor, the first condenser, the decompressor and the evaporator are sequentially connected, and a sub-circuit branched off between the first condenser and the decompressor of the main circuit, at which the second condenser is installed, and joining the intersection and the decompressor, and a circuit switching device configured to branch off the sub-circuit from the main circuit may be installed at the intersection of the heat pump circuit. In this case, the heating value of the second condenser can be adjusted by selectively increasing or decreasing the amount of the refrigerant introduced into the second condenser, and thus the refrigerant temperature and the refrigerant pressure of the heat pump circuit can be adjusted.

In order to adjust the refrigerant temperature and the refrigerant pressure of the heat pump circuit according to a circumstance of the refrigerant temperature and the refrigerant pressure of the heat pump circuit, the heat pump circuit may include a sensing unit disposed in the heat pump circuit downstream from the compressor and configured to sense the refrigerant pressure or the refrigerant temperature, and a control unit configured to control the refrigerant flow rate regulator or the circuit switching device, wherein the amount of the refrigerant introduced into the second condenser is increased or decreased when the control unit obtains a sensing result of the sensing unit and the refrigerant temperature or the refrigerant pressure in the heat pump circuit deviates from a certain range.

When the refrigerant flow rate regulator is closed or the sub-circuit side of the circuit switching valve is closed, in order to prevent the liquefied refrigerant from remaining in the second condenser, in the sub-circuit, a refrigerant flow rate regulator or a circuit switching device may be installed upstream from the second condenser, and a check valve may be installed downstream.

In order to further increase the radiation efficiency of the second condenser, the second condenser may be installed downstream from the exhaust flow path of the evaporator.

In order to prevent an increase in size of the dryer and enable reduction in cost, the evaporator and the second condenser may be integrated.

In order to increase clothes drying efficiency in the drum, a heater configured to auxiliarily heat the suction gas may be installed at the suction flow path.

In addition, a clothes dryer according to the present invention includes a drum configured to accommodate clothes, a suction flow path configured to suction air into the drum, an exhaust flow path configured to exhaust the air from the drum, and a heat pump circuit having a compressor, a condenser, a decompressor, a first evaporator and a second evaporator, wherein the condenser and the second evaporator are installed at the suction flow path and the first evaporator is installed at the exhaust flow path.

As the second evaporator is installed at the suction flow path, the second evaporator exchanges heat with the suctioned air, the second evaporator absorbs the heat, and the temperature of the entire refrigerant in the heat pump circuit can be increased. Accordingly, frosting on the evaporator in the low temperature and low pressure state of the refrigerant in the heat pump circuit can be prevented without enhancement of evaporator capacity or reduction in compressor capacity and without using the variable displacement compressor. In addition, when the temperature of the entire refrigerant in the heat pump circuit is increased, the temperature of the first evaporator is increased and the temperature of the air exhausted to the outside is also increased. Accordingly, dew condensation in the exhaust flow path can be reduced.

Here, in order to increase the refrigerant temperature of the heat pump circuit by independently heating the refrigerant of the heat pump circuit using the second evaporator, the heat pump circuit may include a main circuit to which the compressor, the condenser, the decompressor and the first evaporator are connected in sequence, and a sub-circuit at which the second evaporator is installed, branched off between the decompressor and the first evaporator of the main circuit, and joining the first evaporator and the compressor.

In order to adjust the refrigerant temperature and the refrigerant pressure of the heat pump circuit to a desired value, a refrigerant flow rate regulator may be installed in the sub-circuit upstream or downstream from the second evaporator. In this case, a heat absorption amount of the second evaporator can be adjusted by increasing or decreasing the amount of the refrigerant introduced into the sub-circuit, and thus the refrigerant temperature and the refrigerant pressure of the heat pump circuit can be adjusted to the desired value.

In addition, as another configuration, in order to increase the refrigerant temperature and the refrigerant pressure of the heat pump circuit, the heat pump circuit may include a main circuit to which the compressor, the condenser, the decompressor and the first evaporator are connected in sequence, and a sub-circuit at which the second evaporator is installed, branched off between the decompressor and the first evaporator of the main circuit, and joining the intersection and the first evaporator, wherein a circuit switching device such as a 3-way valve or the like configured to branch off the sub-circuit from the main circuit is installed at the intersection of the heat pump circuit. In this case, the heat absorption amount of the second evaporator can be adjusted by selectively increasing or decreasing the amount of the refrigerant introduced into the second evaporator, and thus the refrigerant temperature and the refrigerant pressure of the heat pump circuit can be adjusted.

In order to adjust the refrigerant temperature and the refrigerant pressure of the heat pump circuit according to a circumstance of the refrigerant temperature and the refrigerant pressure of the heat pump circuit, the heat pump circuit may include a sensing unit disposed between the decompressor and the compressor in the heat pump circuit and configured to sense a refrigerant pressure or a refrigerant temperature, and a control unit configured to control the refrigerant flow rate regulator or the circuit switching device, wherein the amount of the refrigerant introduced into the second evaporator is increased or decreased when the control unit obtains the sensed result of the sensing unit and the refrigerant temperature or the refrigerant pressure in the heat pump circuit is a certain value or less.

In order to further increase the heat absorption efficiency of the second evaporator, the second evaporator may be disposed downstream from the suction flow path of the condenser.

In order to prevent an increase in size of the dryer and enable reduction in cost, the condenser and the second evaporator may be integrated.

In order to increase drying efficiency of clothes in the drum, in addition to the heat pump circuit, a heater configured to auxiliarily heat the suctioned air may be additionally installed at the suction flow path.

In addition, a clothes dryer according to the present invention includes a drum configured to accommodate clothes, a suction flow path configured to suction air into the drum, an exhaust flow path configured to exhaust the air from the drum, and a heat pump circuit having a compressor, a first condenser, a second condenser, a decompressor, a first evaporator and a second evaporator, wherein the first condenser and the second evaporator are installed at the suction flow path, and the first evaporator and the second condenser are installed at the exhaust flow path.

Accordingly, the high temperature and high pressure state of the refrigerant can be prevented, and frosting on the first evaporator in the low temperature and low pressure state of the refrigerant can be prevented.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
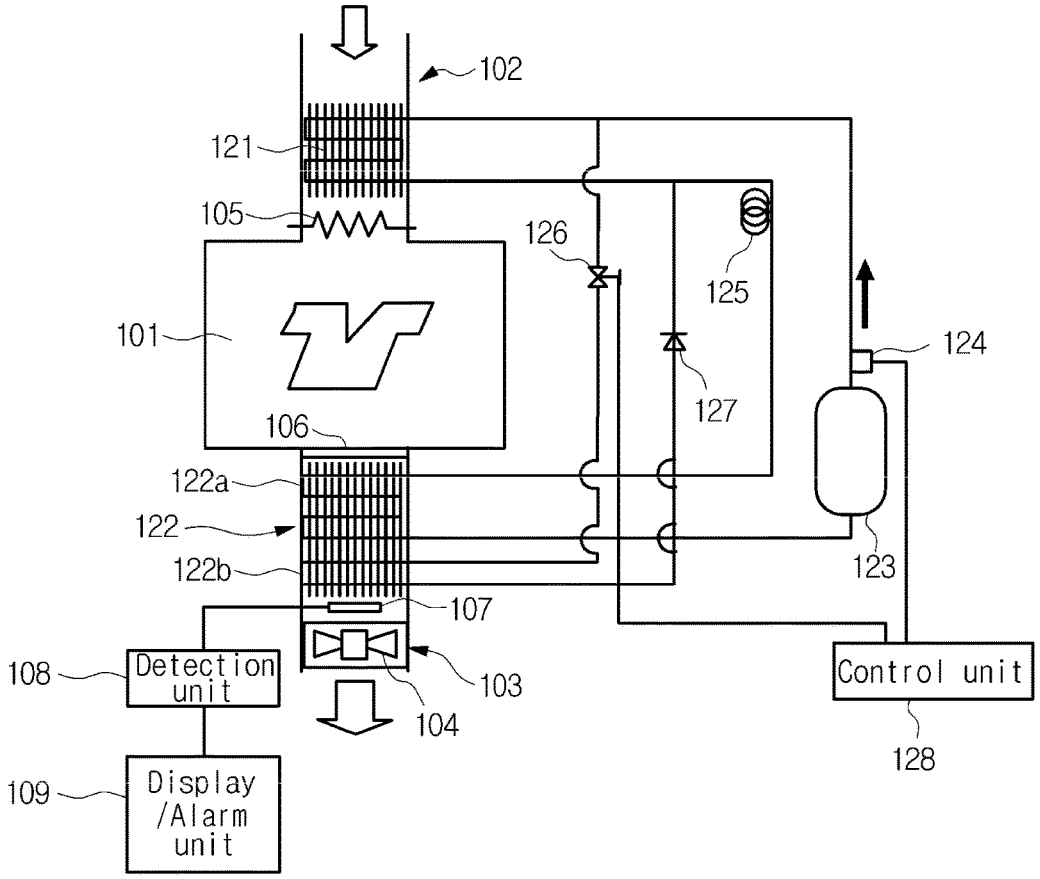
FIG. 1 is a schematic view for describing a schematic configuration of a clothes dryer according to a first embodiment.

Reference will now be made in detail to the embodiments of the present invention, examples of which are illustrated in the accompanying drawings, wherein like reference numerals refer to like elements throughout.

First Embodiment (Configuration of Clothes Dryer)

As shown in FIG. 1, a clothes dryer has, for example, a drying chamber 101 constituted by a rotary drum, a suction passage (an air passage) 102 and an exhaust passage (an air passage) 103, and air is flowed by a blower 104 to dry clothes in the drying chamber 101. A first condenser (a suction-side heat exchanger) 121 and a heater 105 of a heat pump are installed at the suction passage 102. In addition, a filter 106, an exhaust-side heat exchanger 122 and a flow velocity sensor 107 (to be described below) are installed at the exhaust passage 103. A display/alarm unit 109 is connected to the flow velocity sensor 107 through a detection unit 108. The exhaust-side heat exchanger 122 is constituted by an evaporator 122*a* and a second condenser 122*b*.

The heat pump is further constituted by a compressor 123, a refrigerant pressure sensor 124, a decompressor 125, a flow rate regulator 126, a check valve 127 and a control unit 128, in addition to the first condenser 121, the evaporator 122*a* and the second condenser 122*b*. The compressor 123 compresses a refrigerant to a high temperature and high pressure state. The first condenser 121 condenses the refrigerant to overheat air passing through the suction passage 102. The second condenser 122*b* is connected to the first condenser 121 in parallel through the flow rate regulator 126 to be in an operation state when the refrigerant pressure arrives at a predetermined level or more (when a cycle temperature is increased), and compensates a condensation operation by the first condenser 121 (a decrease in pressure by radiating the high temperature high pressure refrigerant). In addition, the evaporator 122*a* evaporates the refrigerant condensed by the first and second condensers 121 and 122*b* and collects heat of the air exhausted from the drying chamber 101. The control unit 128 controls the flow rate regulator 126 according to a detected pressure of the refrigerant pressure sensor 124, and turns ON/OFF an operation of the second condenser 122*b*.

Figure 2:
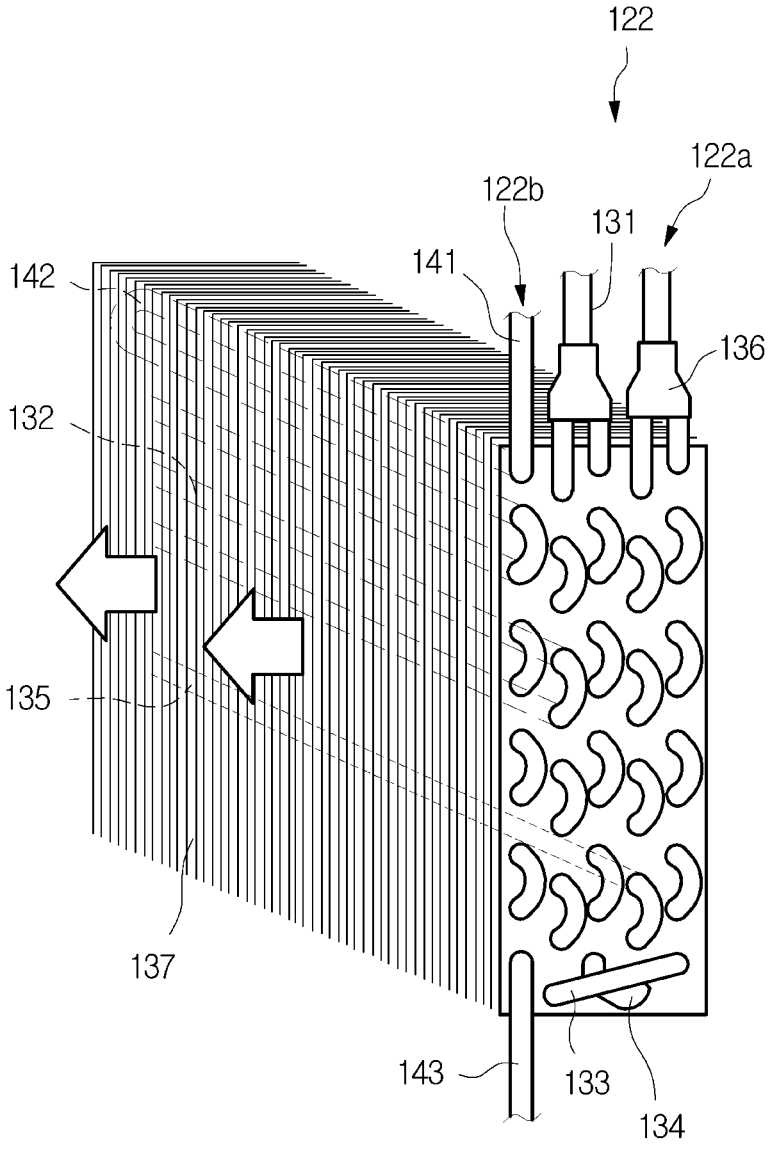
FIG. 2 is a perspective view showing disposition of a refrigerant pipe of a heat exchanger according to the first embodiment.

Specifically, as shown in FIG. 2, the exhaust-side heat exchanger 122 is constituted by the evaporator 122*a* and the second condenser 122*b* integrally combined with each other, for example, to configure a so-called pin and tube type heat exchanger having refrigerant pipes 132, 135 and 142, which are copper pipes, and a pin 137. The refrigerant pipes 132, 135 and 142 are disposed in a horizontal direction and in a direction perpendicular to an airflow direction. In addition, the pin 137 is installed in a direction perpendicular to the refrigerant pipes 132, 135 and 142 (in a direction parallel to the airflow direction).

In the evaporator 122*a*, the refrigerant introduced from a refrigerant introduction section 131 of an upper side of FIG. 2 is bifurcated into two flow paths to reciprocate through a refrigerant pipe 132 in a horizontal direction and moves downward, and then reciprocates through a refrigerant pipe 135 of an upstream side in the airflow direction of the refrigerant pipe 132 via refrigerant pipe connecting sections 133 and 134 and moves upward, being discharged to a refrigerant discharging section 136. In addition, in the second condenser 122*b*, the refrigerant introduced from a refrigerant introduction section 141 of an upper side of FIG. 2 reciprocates through a refrigerant pipe 142 in a horizontal direction and moves downward to be discharged to a refrigerant discharging section 143. In addition, the presence of branches of the above-mentioned refrigerant path, the number of branches, or a layout of the flow path is not limited thereto.

Figure 3:
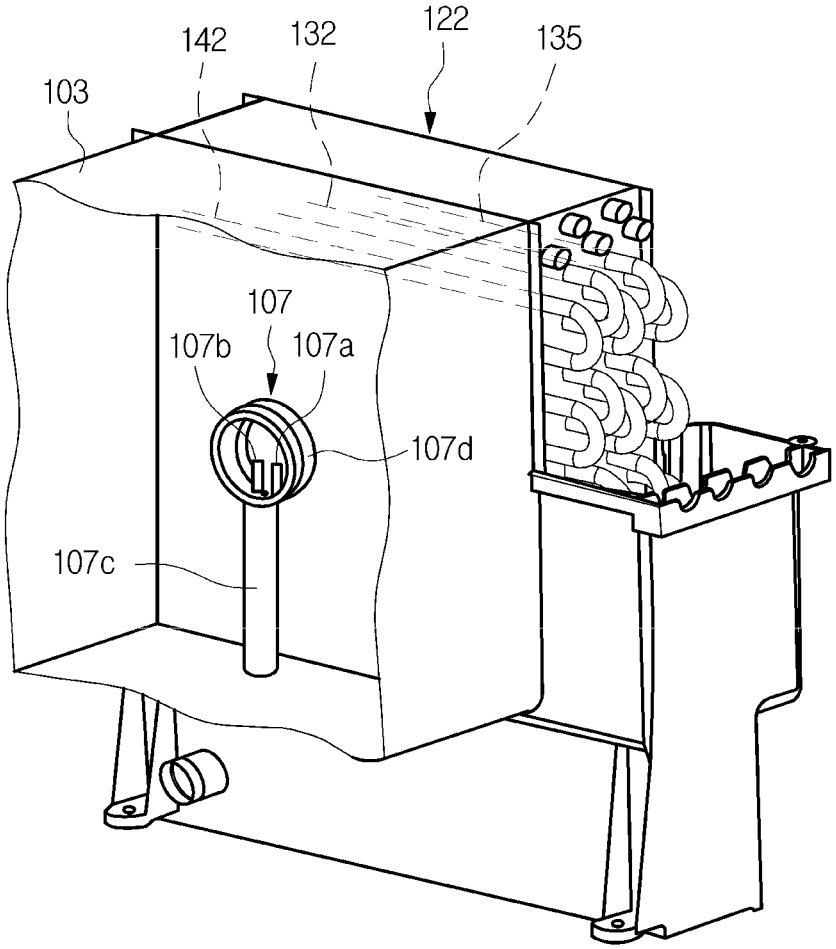
FIG. 3 is a perspective view showing an installation state of a flow velocity sensor on the heat exchanger according to the first embodiment.
Figure 4:
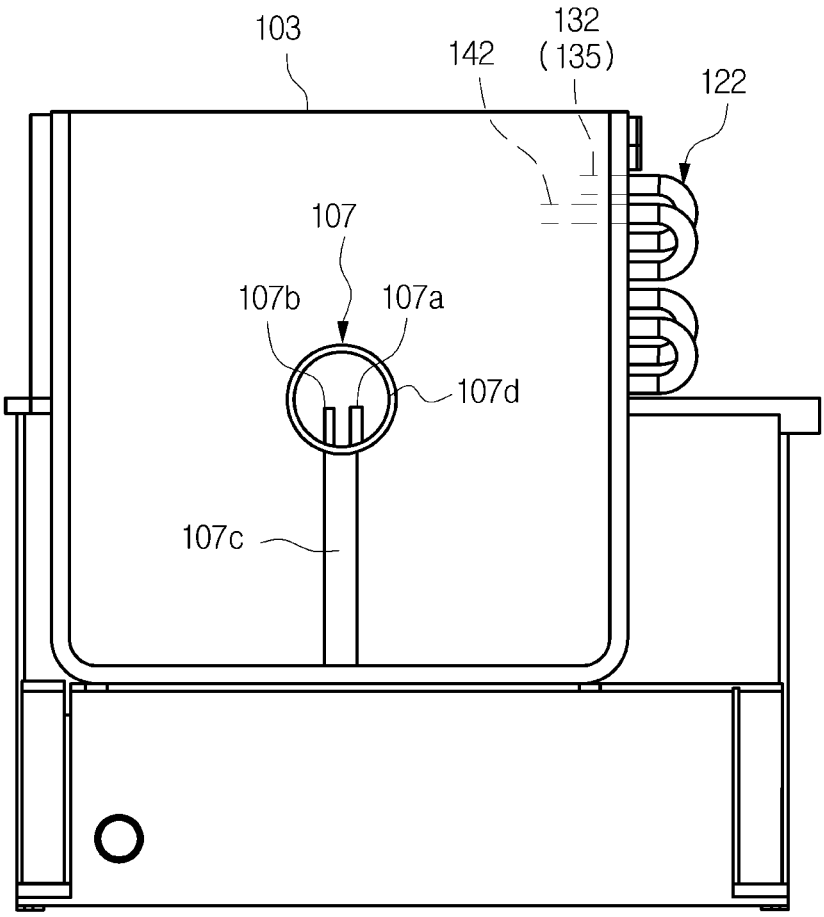
FIG. 4 is a front view showing the installation state of the flow velocity sensor on the heat exchanger according to the first embodiment.
Figure 5:
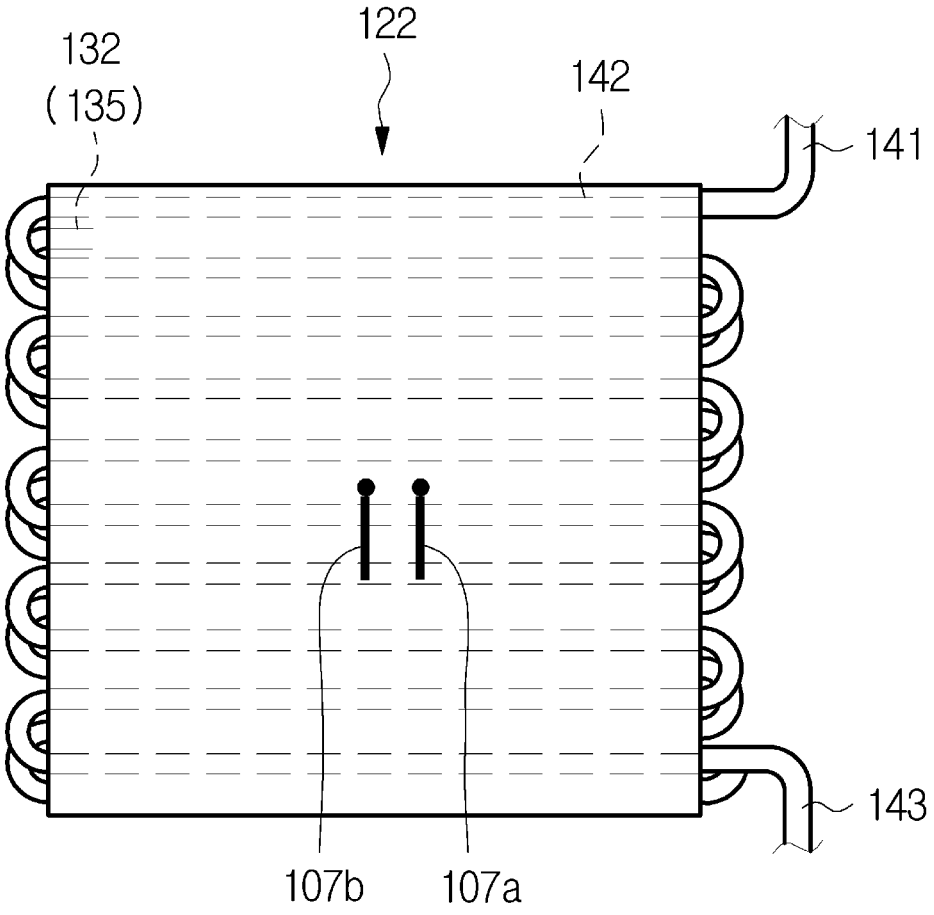
FIG. 5 is a front view showing disposition of the flow velocity sensor according to the first embodiment.
Figure 6:
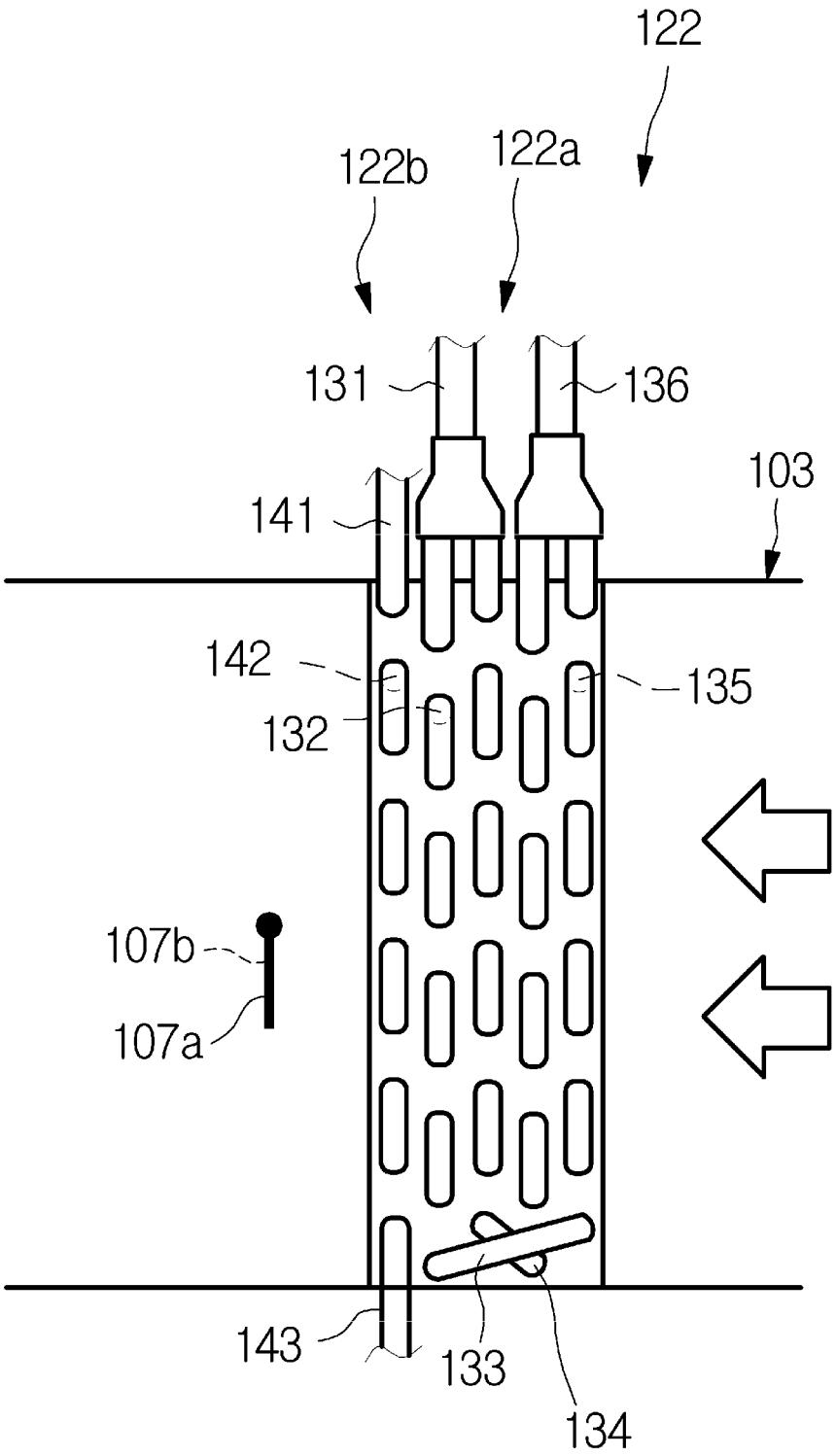
FIG. 6 is a side view showing the disposition of the flow velocity sensor according to the first embodiment.

As shown in FIGS. 3 and 4, the flow velocity sensor 107 is constituted by a hot thermistor (a heat generating body) 107*a* and a temperature compensation thermistor (a temperature detecting body) 107*b*. Although an installation method of the thermistors 107*a* and 107*b* is not limited to an example described below, for example, the thermistors 107*a* and 107*b* are mounted on a column 107*c* vertically installed on a bottom section of the exhaust passage 103 such that central shafts are surrounded by a cylindrical protection ring 107*d* parallel to the airflow direction. As shown in FIGS. 5 and 6, the hot thermistor 107*a* and the temperature compensation thermistor 107*b* are disposed at the same positions in the airflow direction (at the same height) arranged in a direction parallel to the refrigerant pipes 132, 135 and 142 of the exhaust-side heat exchanger 122, i.e., in the horizontal direction.

The detection unit 108 detects a flow velocity (a flow rate, an air volume) of the airflow flowing through the exhaust passage 103 according to a detection result of the thermistors 107*a* and 107*b*. More specifically, the hot thermistor 107*a* is energized to generate heat, and some of the heat exits according to the flow velocity and temperature of the airflow. Here, as compensation of the air temperature is performed according to the detection result of the temperature compensation thermistor 107*b*, the flow velocity of the airflow is detected. For example, the display/alarm unit 109 determines that the flow velocity sensor 107 is clogged when the detected flow velocity is a predetermined level or less, and provides a warning through a certain mark or alarm sound or stops the operation of the clothes dryer.

(Temperature Distribution of Airflow Downstream from Exhaust-Side Heat Exchanger 122 Under Normal Circumstances)

Figure 7:
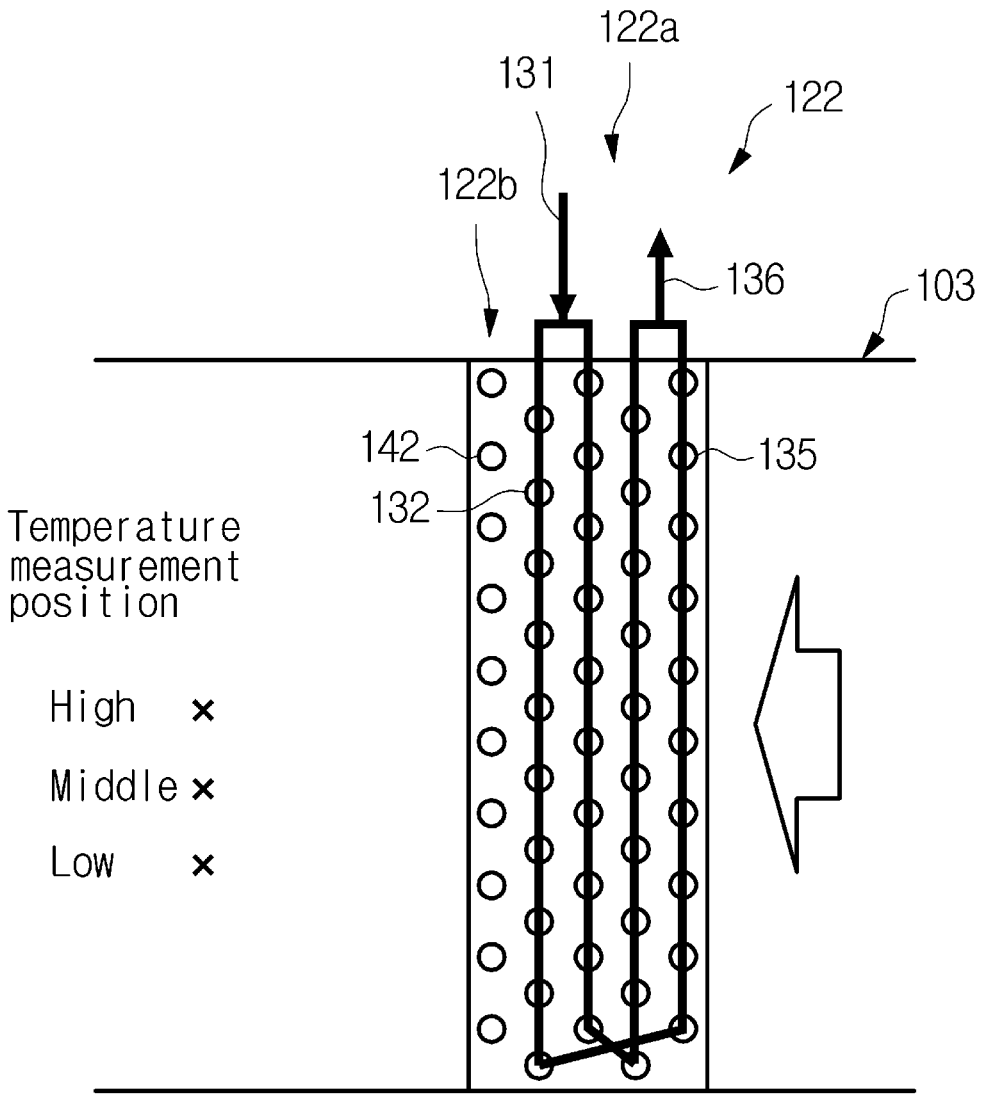
FIG. 7 is a view for describing a refrigerant flow upon non-operation of a second condenser according to the first embodiment.
Figure 8:
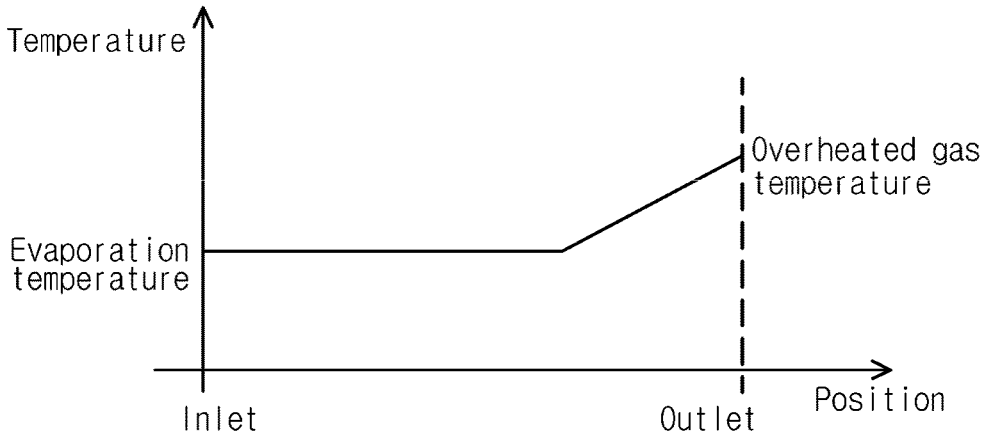
FIG. 8 is a graph showing a temperature of a refrigerant in an evaporator according to the first embodiment.
Figure 9:
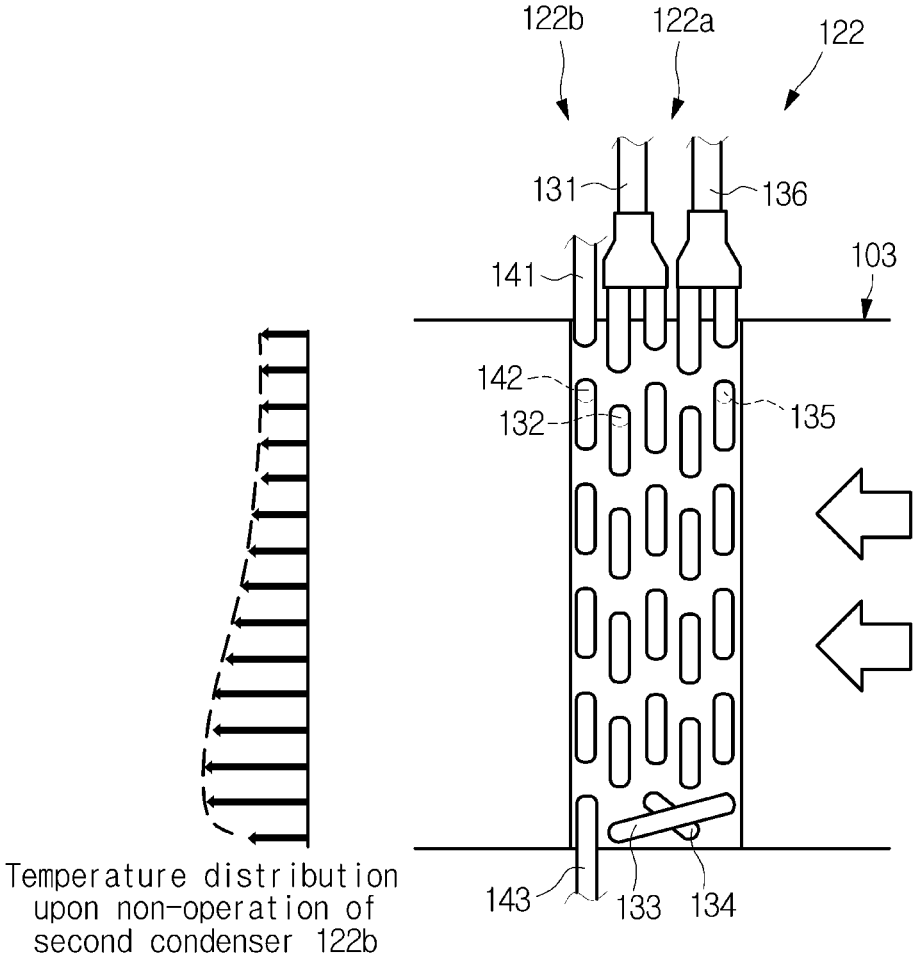
FIG. 9 is a view for describing temperature distribution of airflow upon the non-operation of the second condenser according to the first embodiment.

First, when the flow rate regulator 126 (FIG. 1) is closed and the second condenser 122*b* is not operated, in a normal state, as shown in FIG. 7, a two-phase refrigerant obtained by mixing the liquefied refrigerant condensed by the first condenser 121 with the gasified refrigerant is introduced into the refrigerant introduction section 131 of the evaporator 122*a*. The two-phase refrigerant takes heat from the airflow in the exhaust passage 103 while the liquefied refrigerant is evaporated during circulation through the refrigerant pipes 132 and 135. In addition, the liquefied refrigerant is maintained at a certain evaporation temperature (boiling point) as shown in FIG. 8 when present, and then, when the liquefied refrigerant is entirely evaporated, the gasified refrigerant is overheated to gradually increase a temperature thereof and discharge it from the refrigerant pipe 135. Here, for example, temperature distribution in a vertical direction shown in FIG. 9 is generated at the airflow downstream from the exhaust-side heat exchanger 122.

Figure 11:
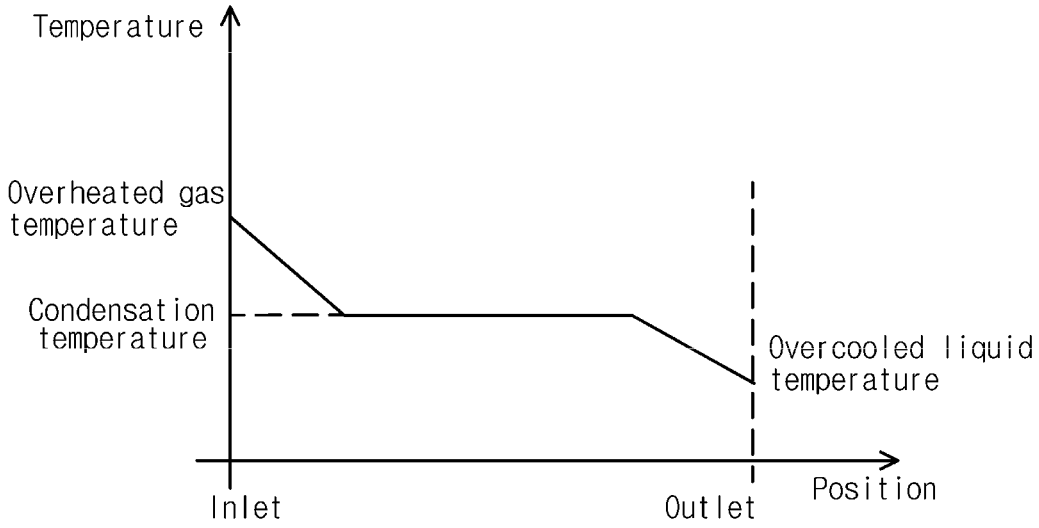
FIG. 11 is a graph showing a temperature of the refrigerant in the second condenser according to the first embodiment.
Figure 12:
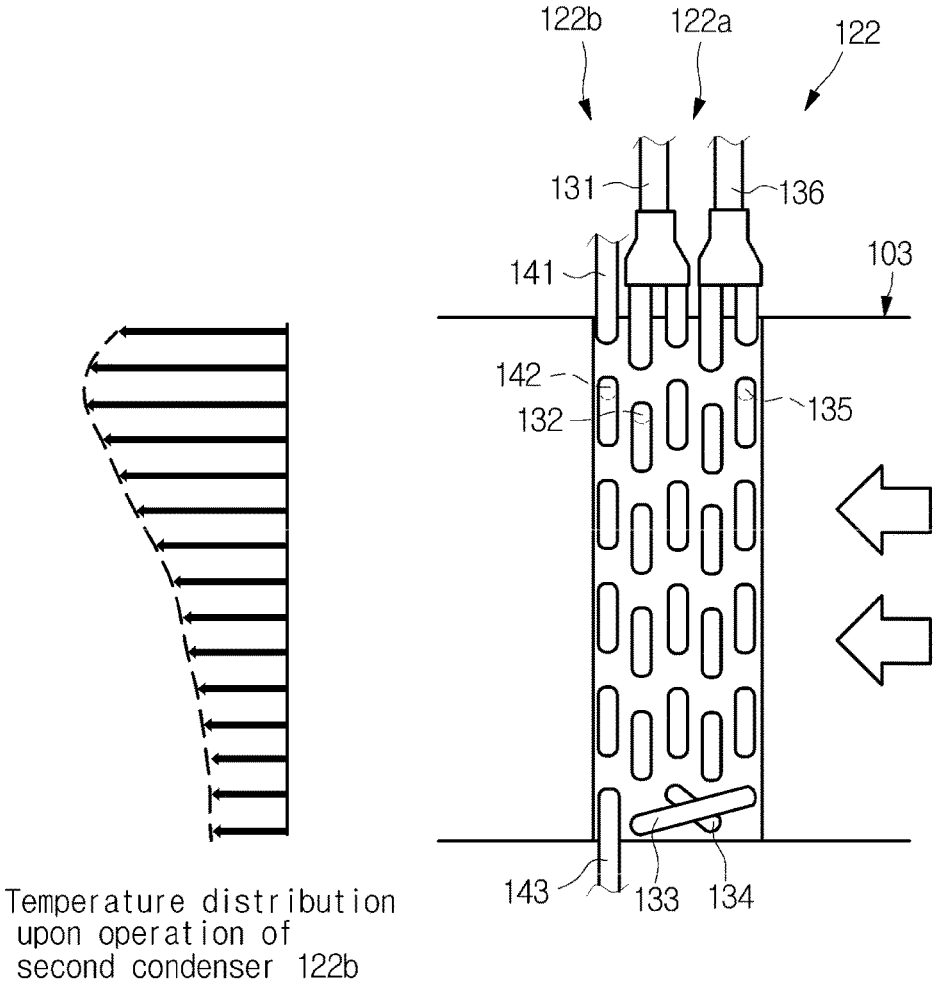
FIG. 12 is a view for describing temperature distribution of an airflow upon the operation of the second condenser according to the first embodiment.

In addition, when the flow rate regulator 126 (FIG. 1) is opened and the second condenser 122*b* is operated, in a normal state, the evaporator 122*a* is operated as described above, and as shown in FIG. 10, in the second condenser 122*b*, the gasified refrigerant compressed and overheated by the compressor 123 is introduced into the refrigerant introduction section 141. The gasified refrigerant emits heat to the airflow in the exhaust passage 103 to be cooled while flowing through the refrigerant pipe 142 as shown in FIG. 11, the liquefied refrigerant is maintained at a condensation temperature and then further cooled when the liquefied refrigerant is generated, and the liquefied refrigerant is overcooled to be gradually reduced in temperature when the gasified refrigerant is entirely condensed, thus being discharged to the refrigerant discharging section 143. Here, temperature distribution in a vertical direction as shown in FIG. 12 is generated at the airflow downstream from the exhaust-side heat exchanger 122.

Figure 13:
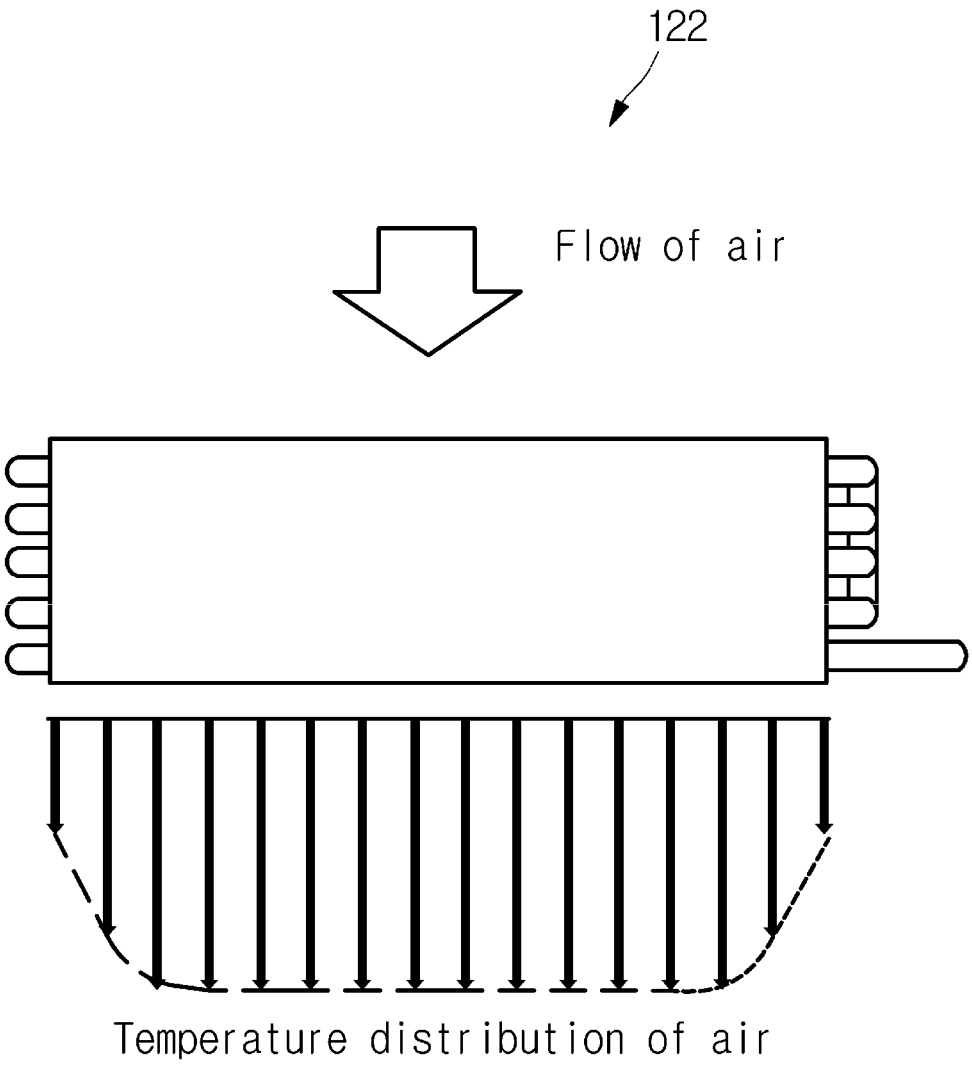
FIG. 13 is a view for describing temperature distribution of an airflow in a direction parallel to a refrigerant pipe according to the first embodiment.

Here, since a variation in refrigerant temperature while the refrigerant moves through the refrigerant pipes 132, 135 and 142 in the horizontal direction is generally small, for example, the temperature distribution in the horizontal direction of the airflow downstream from the exhaust-side heat exchanger 122 (the direction parallel to the refrigerant pipes 132, 135 and 142) is substantially uniform except for around both side sections having relatively low cooling efficiency as shown in FIG. 13.

(Transitional Variation and Temperature Distribution of Airflow Temperature Downstream from Exhaust-Side Heat Exchanger 122)

Figure 10:
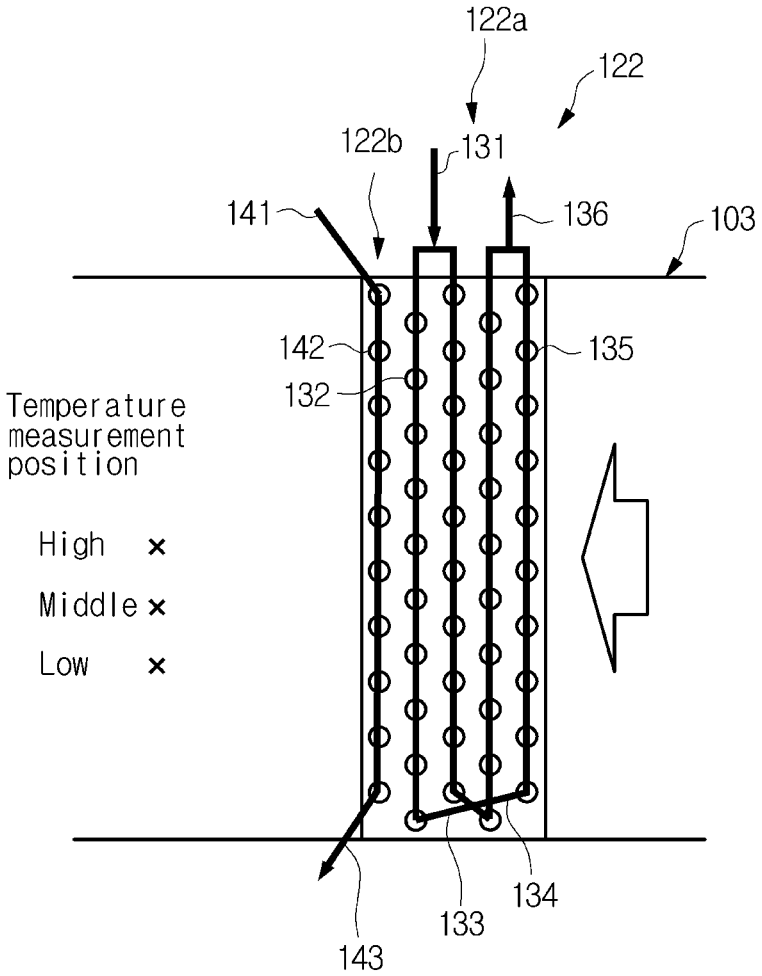
FIG. 10 is a view for describing a flow of the refrigerant upon an operation of the second condenser according to the first embodiment.
Figure 14:
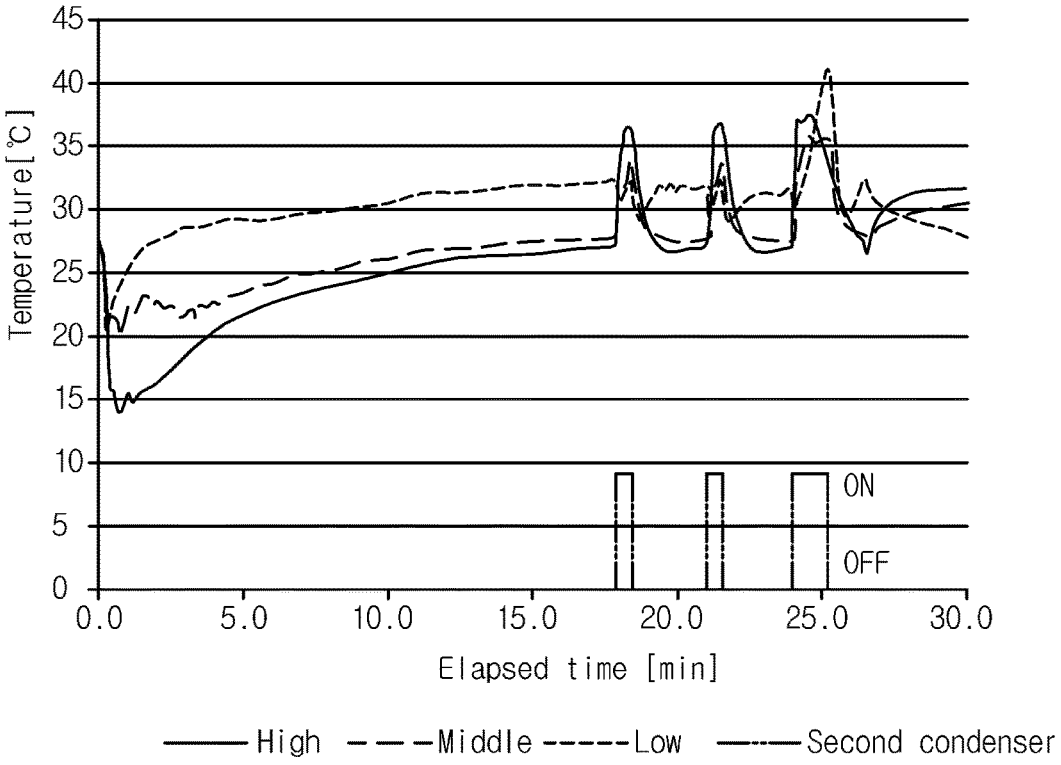
FIG. 14 is a view for describing temperature distribution of the airflow according to the first embodiment as time elapses.

FIG. 14 shows a variation in airflow temperature at upper, middle and lower positions represented by marks x in FIGS. 7 and 10 of the downstream side of the exhaust-side heat exchanger 122 when an operation of the second condenser 122*b* is turned ON/OFF when the clothes dryer starts to operate or is in operation. When the operation is started as shown in FIG. 14, first, since the low temperature low pressure refrigerant flows from the refrigerant introduction section 131 while an evaporation position is varied, the airflow temperature is abruptly decreased as it goes upward. That is, airflow temperature differences at the upper, middle and lower positions are also varied as time elapses. For example, when about 7 minutes elapse and the temperature distribution approaches the normal state, even when the airflow temperatures at the upper, middle and lower positions are varied, the temperature difference becomes substantially uniform.

Meanwhile, when the second condenser 122*b* is turned ON/OFF, since the high temperature high pressure refrigerant flows from the refrigerant introduction section 141 when turned ON, the airflow temperature is abruptly increased at it goes upward, and the temperature distribution is inverted. In this case, the overheated gasified refrigerant is introduced into the second condenser 122*b* to become the 2-phase refrigerant, and then the overcooled liquefied refrigerant is discharged. When the airflow temperature differences are largely increased at the upper, middle and lower positions and ON/OFF of the second condenser 122*b* are repeated, the temperature distribution becomes unstable.

Figure 15:
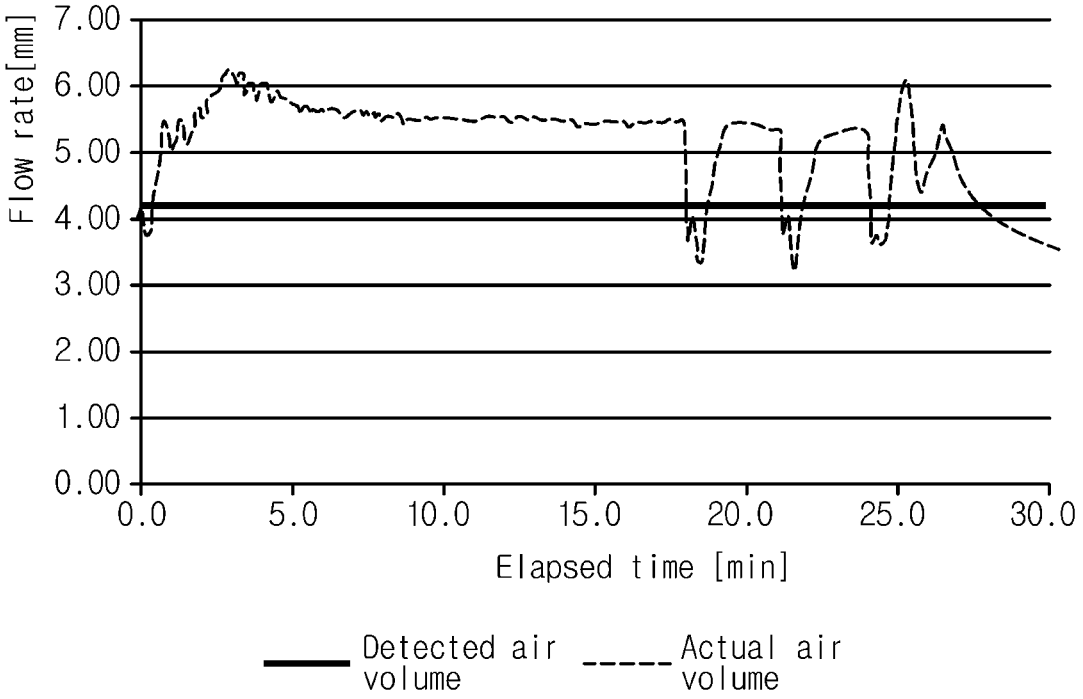
FIG. 15 is a graph showing a relation between a detected air volume of a comparative example and an actual air volume.

Here, for example, in a comparative example, when the hot thermistor 107*a* is disposed at the middle position shown in FIGS. 7 and 10 and the temperature compensation thermistor 107*b* is disposed at the lower position, upon starting of the clothes dryer, for example, the temperature of the airflow flowing at the position of the hot thermistor 107*a* is decreased to be largely lower than the temperature (the compensated temperature) of the airflow flowing at the position of the temperature compensation thermistor 107*b*. In this case, the detection result of the hot thermistor 107*a* is equal to the detection result when the air volume is larger in a state in which both of the airflow temperatures are equal to each other. Accordingly, for example, as shown in FIG. 15, even when the air volume is detected to be larger than the actual air volume and the filter is clogged, the clogging may not be detected. Meanwhile, when the second condenser 122*b* is operated, for example, the temperature of the airflow flowing at the position of the hot thermistor 107*a* is increased to be higher than the temperature (the compensated temperature) of the airflow flowing at the position of the temperature compensation thermistor 107*b*. In this case, the detection result of the hot thermistor 107*a* is equal to the detection result when the air volume is smaller in a state in which both of the airflow temperatures are equal to each other. Accordingly, for example, as shown in FIG. 15, even when the air volume is detected to be smaller than the actual air volume and the filter is not clogged, malfunctions such as an alarm of the clogging or stoppage of the operation of the clothes dryer may occur. That is, in the case of an air conditioner or a humidifier, even when the temperature distribution is provided in the airflow, since a stabilization time is relatively long, a temperature difference effect can be corrected. However, in the case of the clothes dryer using the heat pump, since the airflow temperature distribution is relatively large and the temperature distribution is complicated, the airflow temperatures and variations thereof may differ at positions when only the thermistors 107*a* and 107*b* are provided, and the filter clogging cannot be precisely detected.

However, in comparison with the comparative example, like the embodiment, when the hot thermistor 107*a* and the temperature compensation thermistor 107*b* are disposed in a direction parallel to the refrigerant pipes 132, 135 and 142 (FIGS. 5 and 6), the temperature of the airflow flowing at the positions of the thermistors 107*a* and 107*b* is substantially constantly varied even when the clothes dryer starts to operate or the second condenser 122*b* is operated. In addition, since the thermistors 107*a* and 107*b* are disposed in a direction perpendicular to the airflow, heat of the hot thermistor 107*a* does not affect the temperature compensation thermistor 107*b* or the flow velocity at which the temperature compensation thermistor 107*b* touches the hot thermistor 107*a*. Accordingly, even when it is not operating normally, the flow velocity or the air volume of the airflow can be precisely detected with a relatively simple configuration to more precisely detect the filter clogging.

In addition, when the second condenser 122*b* is installed as described above, the temperature distribution variation by the ON/OFF of the operation is increased and thus the thermistors 107*a* and 107*b* are disposed in the direction parallel to the refrigerant pipes 132, 135 and 142 to obtain a large effect. However, the embodiment is not limited thereto, and even when the second condenser 122*b* is not installed, for example, the thermistors 107*a* and 107*b* are disposed downstream from the evaporator 122*a* in the direction parallel to the refrigerant pipes 132 and 135, and thus an influence on the temperature distribution variation upon starting of the clothes dryer can be suppressed.

In addition, as the thermistors 107*a* and 107*b* are installed downstream from the exhaust-side heat exchanger 122, the air stream is stabilized due to the rectification effect of the pin 137, and thus precise detection can be further facilitated. In this regard, while the thermistors 107*a* and 107*b* may be installed downstream from the first condenser 121, in general, it is advantageous that the thermistors 107*a* and 107*b* be installed downstream from the exhaust-side heat exchanger 122 to decrease the airflow temperature to a relatively low level.

(Variant)

Figure 16:
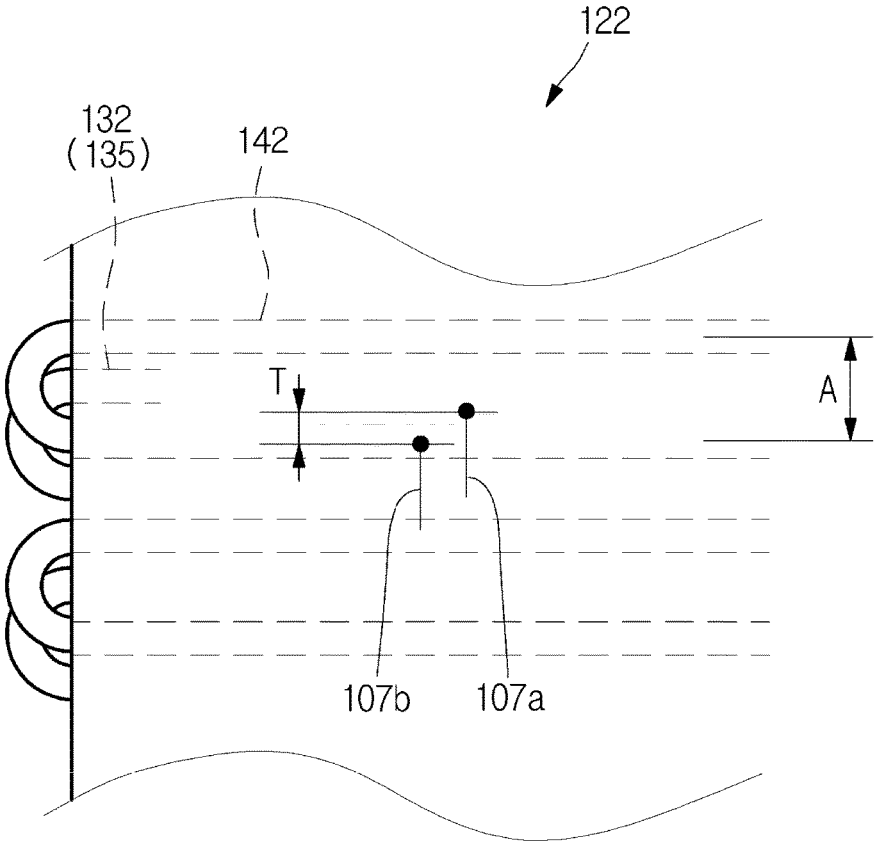
FIG. 16 is a front view showing disposition of a flow velocity sensor of a variant.

In addition, while positional precision in the vertical direction may be generally higher when the thermistors 107*a* and 107*b* are disposed in the direction parallel to the direction of the refrigerant pipes 132, 135 and 142, for example, as shown in FIG. 16, the thermistors 107*a* and 107*b* may be precisely disposed such that a height position error T thereof is ½ or less of a pitch A of the refrigerant pipes 142 or the like. In this case, even when the thermistors 107*a* and 107*b* are not precisely aligned with the refrigerant pipe 142 or the like, they are not easily affected by the neighboring refrigerant pipes 142 or the like, and thus relatively precise flow velocity detection is facilitated.

(Anemometer)

Next, a specific structure of an anemometer, which is a kind of the above-mentioned flow velocity sensor 107, will be described.

Here, a conventional anemometer 200 will be described with reference to FIG. 17. The anemometer 200 is constituted by a rectification unit 202, a pair of thermistors 204 and 204, and so on.

The thermistor 204 is a thermistor for measurement and standard temperature. A platinum wire or the like may be used as a self-heating element.

The rectification unit 202 is formed in a cylindrical structure with both ends open, and both of the thermistors 204 are horizontally disposed inside the rectification unit 202 and protrude toward a central section thereof. The rectification unit 202 is disposed such that one opening is directed upward, and functions to stabilize a wind flow in contact with both of the thermistors 204.

When the air stream is installed at a stable place, the rectification unit 202 is not necessarily required. However, in the case of the dryer, since the air volume is large and the exhaust duct cross-sectional area is large, the air stream is unstable. In addition, since the dryer is installed near the evaporator, when the air flows through the evaporator and turbulence of the airflow is large, the rectification unit may be installed.

Figure 17:
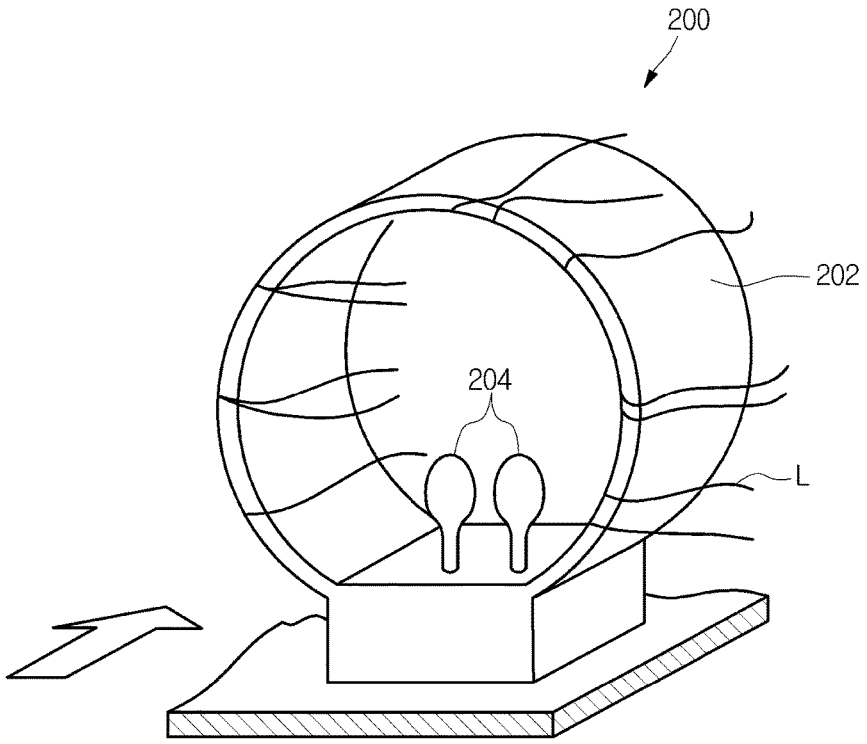
FIG. 17 is a schematic perspective view showing a conventional anemometer.

For this reason, when the conventional anemometer 200 is installed at the dryer, a portion of lint L that has intruded into the exhaust duct is hooked by the rectification unit 202 as shown in FIG. 17. When the lint L is hooked by the rectification unit 202, measurement precision of the anemometer 200 may be decreased.

Accordingly, the lint L hooked by the rectification unit 202 should be manually removed, but in order to remove the lint L, the anemometer 200 should be removed. In order to remove the anemometer 200, an inconvenient disassembly operation such as removal of a drying drum or the like should be performed, which consumes a large amount of time.

Here, in the dryer anemometer, since the lint L can be automatically removed even when the lint L is hooked by the rectification unit, a structure of the anemometer is improved such that the inconvenient disassembly operation need not be performed.

(Structural Example of Anemometer)

Figure 18:
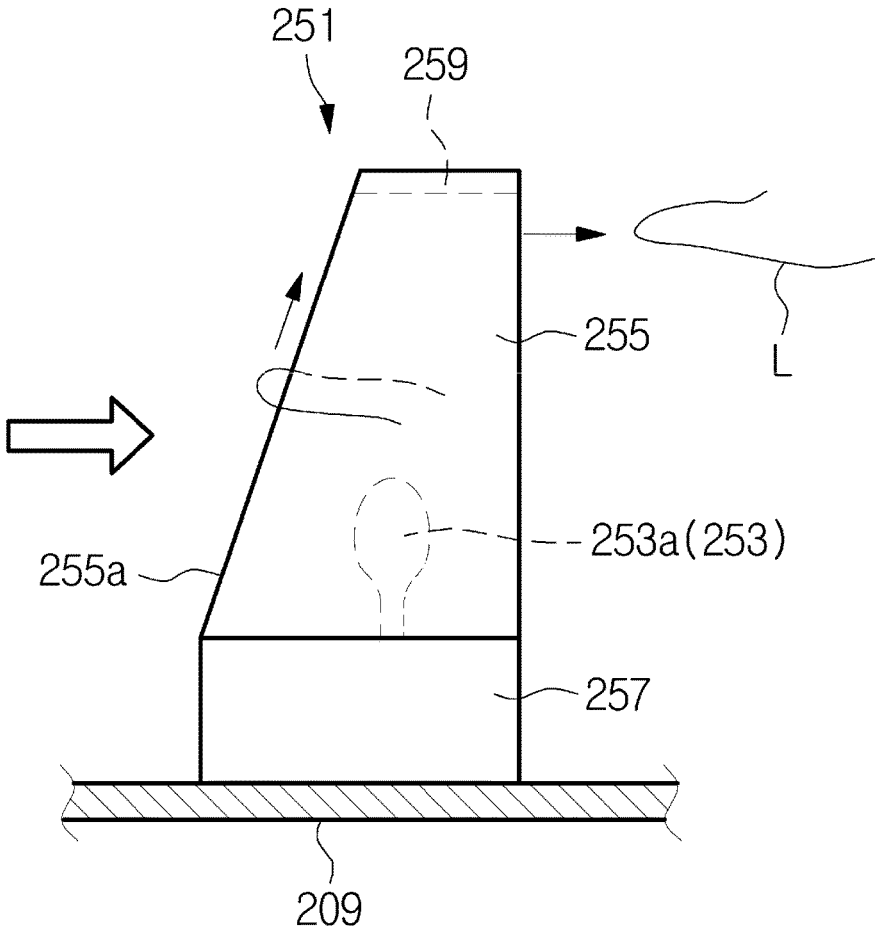
FIG. 18 is a schematic side view showing an anemometer according to the embodiment.
Figure 19:
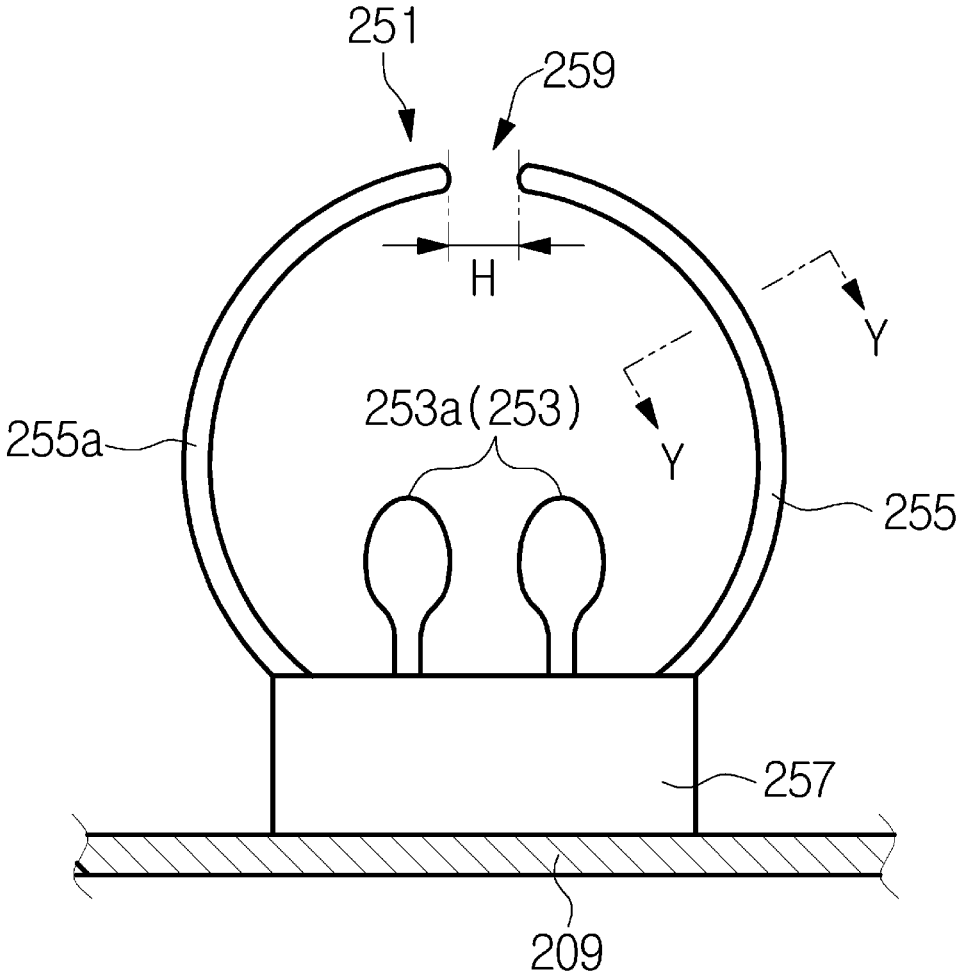
FIG. 19 is a schematic front view of the anemometer of FIG. 18 when seen from above.
Figure 20:
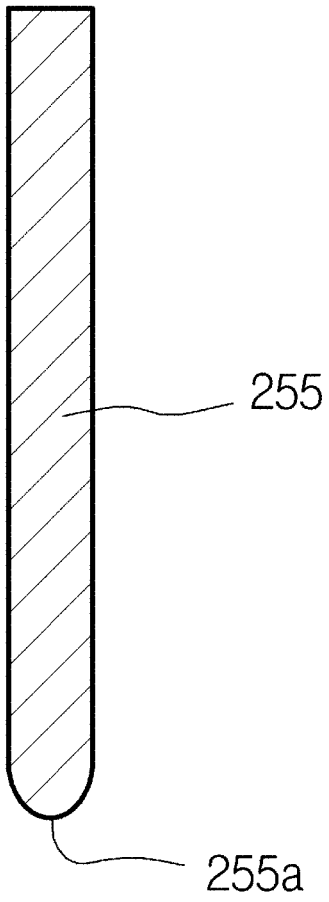
FIG. 20 is a schematic cross-sectional view taken along line Y-Y of FIG. 19.

FIGS. 18 to 20 show an improved anemometer 251 of the embodiment. In addition, a white arrow of FIG. 18 shows an airflow direction (similar in FIG. 21 or the like).

The anemometer 251 is constituted by a sensor unit 253, a rectification unit 255, a base section 257, and so on. The base section 257 has a prismatic shape, and a lower surface thereof is mounted on an inner surface of an exhaust duct 209.

The rectification unit 255 has a cylindrical shape with both ends open, and is coupled to both side peripheries of the upper surface of the base section 257 to be supported by the base section 257. The rectification unit 255 is disposed such that one opening is opposite to an upwind side (upstream from the exhaust duct 209).

The sensor unit 253 is constituted by a pair of thermistors 253*a* and 253*a* for measurement and standard temperature, which is similar to the conventional anemometer 200. A base section of the thermistor 253*a* connected to an interconnection is buried in the base section 257, and a detection portion of the thermistor 253*a* protrudes from an upper surface of the base section 257 to be disposed inside the rectification unit 255.

A row of slits 259 extending straightly in the airflow direction are formed at a position of the rectification unit 255 opposite to the upper surface of the base section 257. The rectification unit 255 is divided by the slit 259 into a pair of bilaterally symmetrical arc-shaped sections extending from the base section 257.

Since the slit 259 is formed in the rectification unit 255, the lint L hooked by the rectification unit 255 can be removed through the slit 259.

A width (H, a minimum width) of the slit 259 may be set to 5 mm or less. While the slit 259 may have a width such that at least the lint L can pass therethrough, when the width is larger than 5 mm, the air stream in contact with the sensor unit 253 is likely to be scattered.

In addition, since the slit 259 is formed at a position farthest from the base section 257 at which the sensor unit 253 is installed, the air stream in contact with the sensor unit 253 is not scattered. Since the rectification unit 255 is bilaterally symmetrical with respect to the slit 259, discharge of the lint L does not deviate.

In addition, a periphery section 255*a* of the rectification unit 255 disposed at the upwind side is formed to be inclined downwind from the base section 257 to the slit 259. Accordingly, the lint L hooked by the rectification unit 255 is gathered at the slit 259 by the wind pressure and automatically discharged by the rectification unit 255, removing necessity of removal of the lint L.

As shown in FIG. 20, the periphery section 255*a* of the upwind side of the rectification unit 255 has a cross-section formed in a curved surface shape protruding toward the upwind side. Accordingly, the lint L hooked by the rectification unit 255 is likely to slip on the periphery section 255*a* to be more easily discharged through the slit 259.

Accordingly, since the lint L is automatically removed by the wind pressure even when the lint L is hooked by the rectification unit 255 according to the anemometer 251, it is possible to implement a dryer capable of removing necessity of maintenance such that a complex disassembly operation is not required.

(First Variant of Anemometer)

Figure 21:
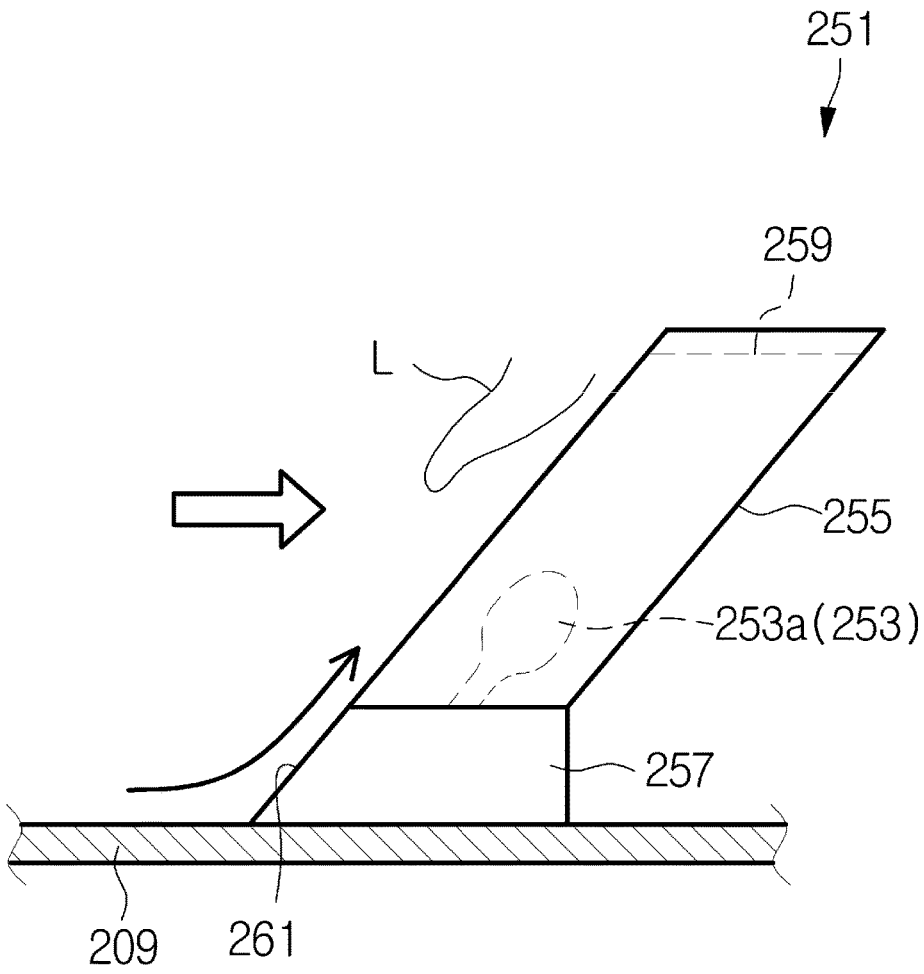
FIG. 21 is a schematic side view showing a first variant of the anemometer.

FIG. 21 shows a first variant of the anemometer 251. In the variant, the sensor unit 253 and the base section 257 are mainly improved.

First, the thermistors 253*a* are inclined toward the downwind side from a bottom section to a protrusion end thereof with respect to the sensor unit 253. Since the thermistors 253*a* are disposed at a portion of the rectification unit 255 at which a width is reduced, the lint L is not easily hooked. In addition, since the thermistors 253*a* are inclined toward the downwind side, the lint L can be more smoothly discharged.

In addition, a side surface of the upwind side of the base section 257 in front of the rectification unit 255 is inclined toward the downwind side from the mounting portion to the rectification unit 255 to form a guide surface 261. As the guide surface 261 is provided at the upwind side of the base section 257, the air in contact with the guide surface 261 passes in front of the rectification unit 255 to flow in an inclined direction.

Accordingly, the air stream configured to block the front of the sensor unit 253 is formed to block the lint L flowing along the exhaust duct 209 using the air stream so that the lint L is not hooked by the sensor unit 253.

(Second Variant of Anemometer)

Figure 22:
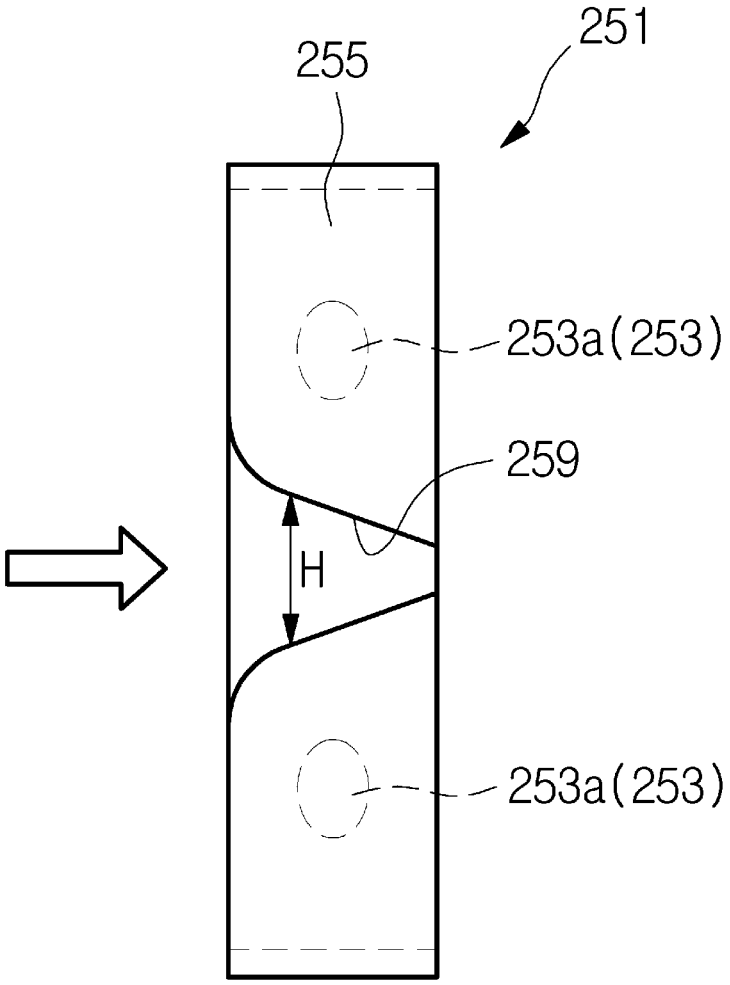
FIG. 22 is a schematic view showing major parts of a second variant of the anemometer.

FIG. 22 shows a second variant of the anemometer 251. In the variant, a shape of the slit 259 is modified. That is, the width H of the slit 259 is not constant but is formed to be gradually reduced from the upwind side toward the downwind side.

When the slit 259 is formed as described above, the air stream in the slit 259 becomes faster at the downwind side than at the upwind side. As a result, the lint L is likely to be suctioned into the slit 259 to accelerate discharge of the lint L.

In addition, the clothes dryer according to the present invention is not limited to the above-mentioned embodiment but may include various other configurations.

Figure 23:
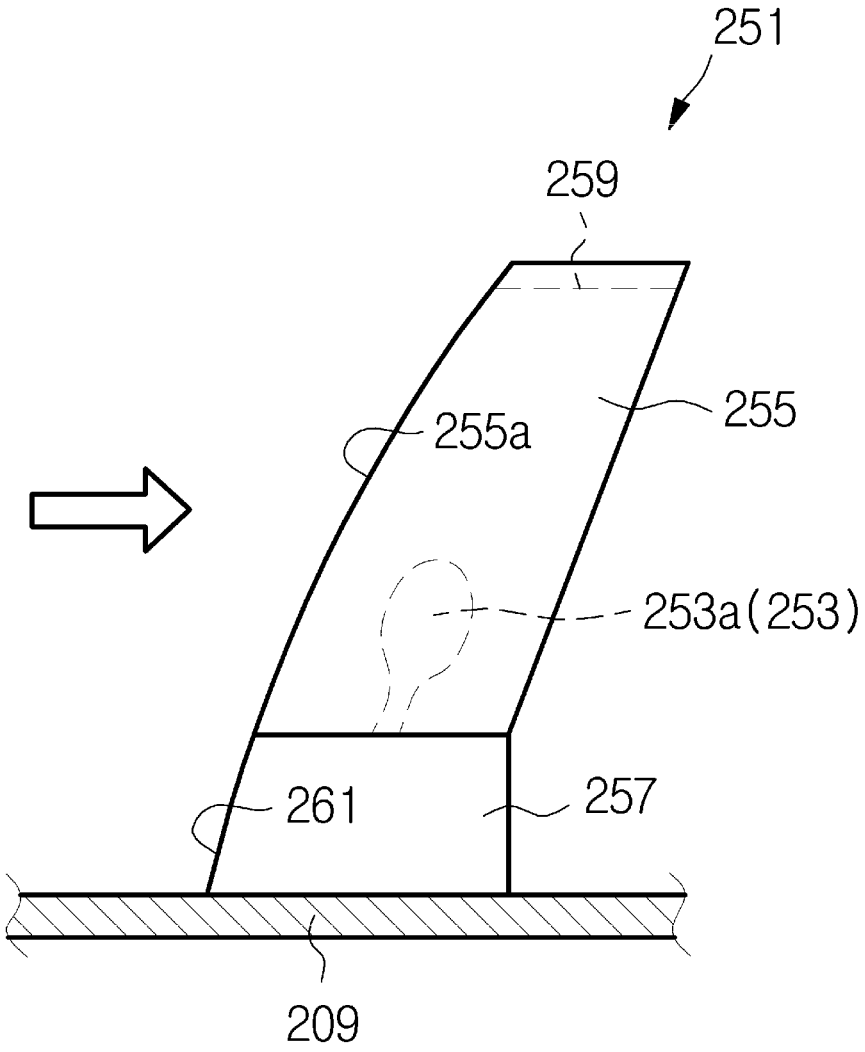
FIG. 23 is a schematic side view showing another variant of the anemometer.

For example, as shown in FIG. 23, the periphery section 255*a* or the like of the rectification unit 255 may be inclined in a straight shape or a streamlined shape when seen in a side view.

While the embodiment is applied to the exhaust type dryer, the embodiment may be applied to a circulation type dryer. A heater may be installed at a suction duct instead of the heat pump.

Second Embodiment

Figure 24:
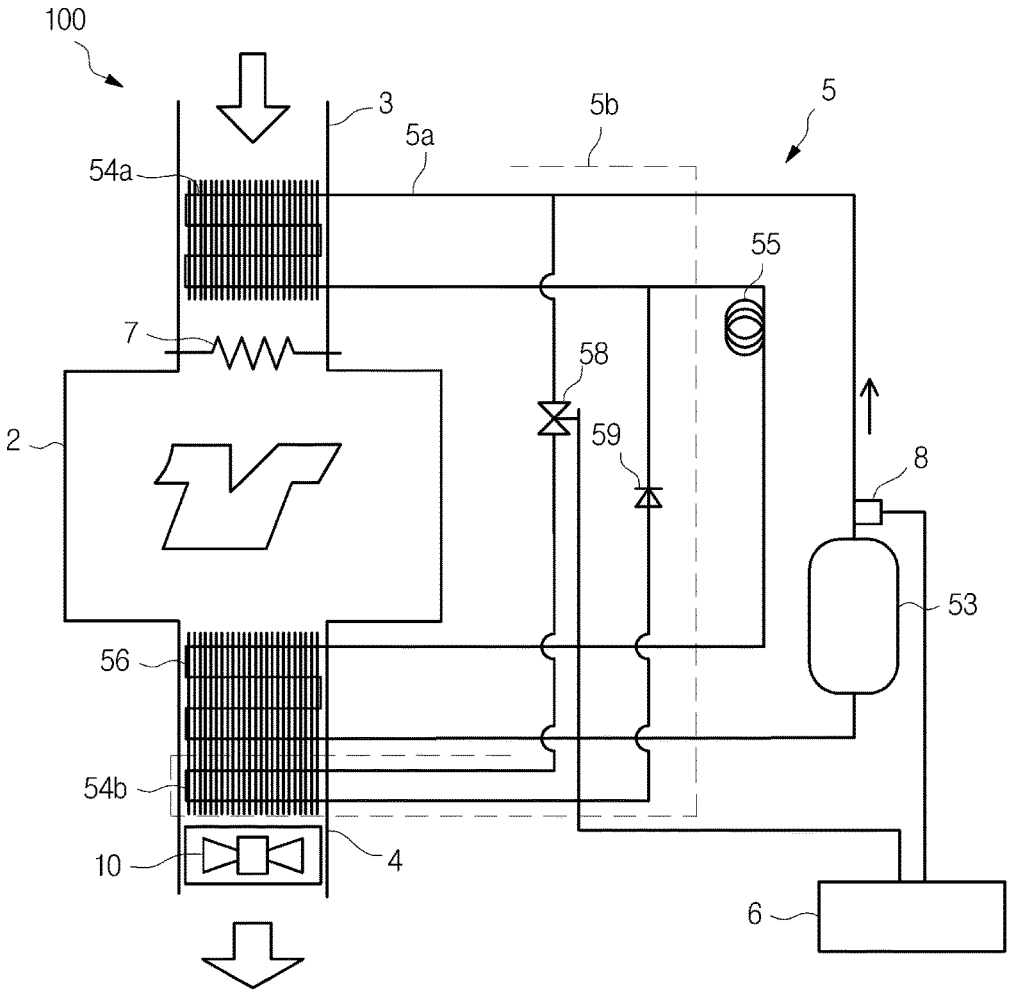
FIG. 24 is a schematic view showing a configuration of a clothes dryer according to a second embodiment.

A clothes dryer 100 of a second embodiment is a suction/exhaust type, and as shown in FIG. 24, includes a drum 2 configured to accommodate clothes, a suction flow path 3 configured to suction air into the drum 2, an exhaust flow path 4 configured to exhaust the air from the drum 2, a heat pump circuit 5, and a control unit 6 configured to control the respective parts of the clothes dryer 100. In addition, a heater 7 configured to auxiliarily heat the suctioned air is installed at the suction flow path 3.

The heat pump circuit 5 has a main circuit 5*a* to which a compressor 53, a first condenser 54*a*, a decompressor 55 and an evaporator 56 are sequentially connected in a loop shape, and a sub-circuit 5*b* branched off between the compressor 53 and the first condenser 54*a* at the main circuit 5*a*, to which a refrigerant flow rate regulator 58, a second condenser 54*b* and a check valve 59 are sequentially connected, and joining the first condenser 54*a* and the decompressor 55. In addition, the first condenser 54*a* is installed in the suction flow path 3 to exchange heat with the air, and the second condenser 54*b* and the evaporator 56 are installed in the exhaust flow path 4 to exchange heat with the air.

The second condenser 54*b* is disposed in the exhaust flow path 4 downstream from the evaporator 56*d*. According to the above-mentioned disposition, the second condenser 54*b* can exchange heat with the low temperature exhaust air cooled by the evaporator 56 to abruptly increase a radiation effect of the second condenser 54*b*.

The refrigerant flow rate regulator 58 is a flow rate control valve such as a motor-operated valve, an electronic valve, or the like, and adjusts a refrigerant flow rate by varying a valve opening angle. In addition, the flow rate control valve 58 is disposed in the vicinity of an intersection of the sub-circuit 5*b* with the main circuit 5*a*. According to the above-mentioned disposition, the refrigerant can be prevented from remaining in the sub-circuit 5*b* generated when the flow rate control valve 58 is closed as much as possible.

The check valve 59 is disposed at a joining point of the sub-circuit 5*b* with the main circuit 5*a*. According to the above-mentioned disposition, the refrigerant can be prevented from remaining in the sub-circuit 5*b* from the joining point generated when the flow rate control valve 58 is closed.

A sensing unit 8 configured to measure a pressure of a refrigerant introduced into the first condenser 54*a* is installed at an inlet of an ejection pipe (the first condenser 54*a*) of the compressor 53 with respect to the heat pump circuit 5.

A blower 10 configured to blow the air from the inside of the drum 2 toward the outside of the drum 2 is installed in the exhaust flow path 4 downstream from the second condenser 54*b*. As the blower 10, a centrifugal fan such as a multi-blade fan, a turbo fan, or the like, having a high static pressure, is used in consideration of pressure loss of the exhaust duct.

The control unit 6 is a so-called computer having a CPU, a memory, an I/O channel, an output device such as a display or the like, an input device such as a keyboard or the like, an AD converter, and so on, and controls the respective parts of the clothes dryer 100 to dry clothes by operating the CPU and peripheral devices thereof according to a control program stored in the memory.

Specifically, the control unit 6 obtains a detection signal from the sensing unit 8 to control the flow rate control valve 58 based on the refrigerant pressure represented by the detection signal, and controls a flow rate of the refrigerant introduced into the second condenser 54*b*.

Hereinafter, a control method of the clothes dryer 100 will be described with reference to the accompanying drawings.

Figure 25:
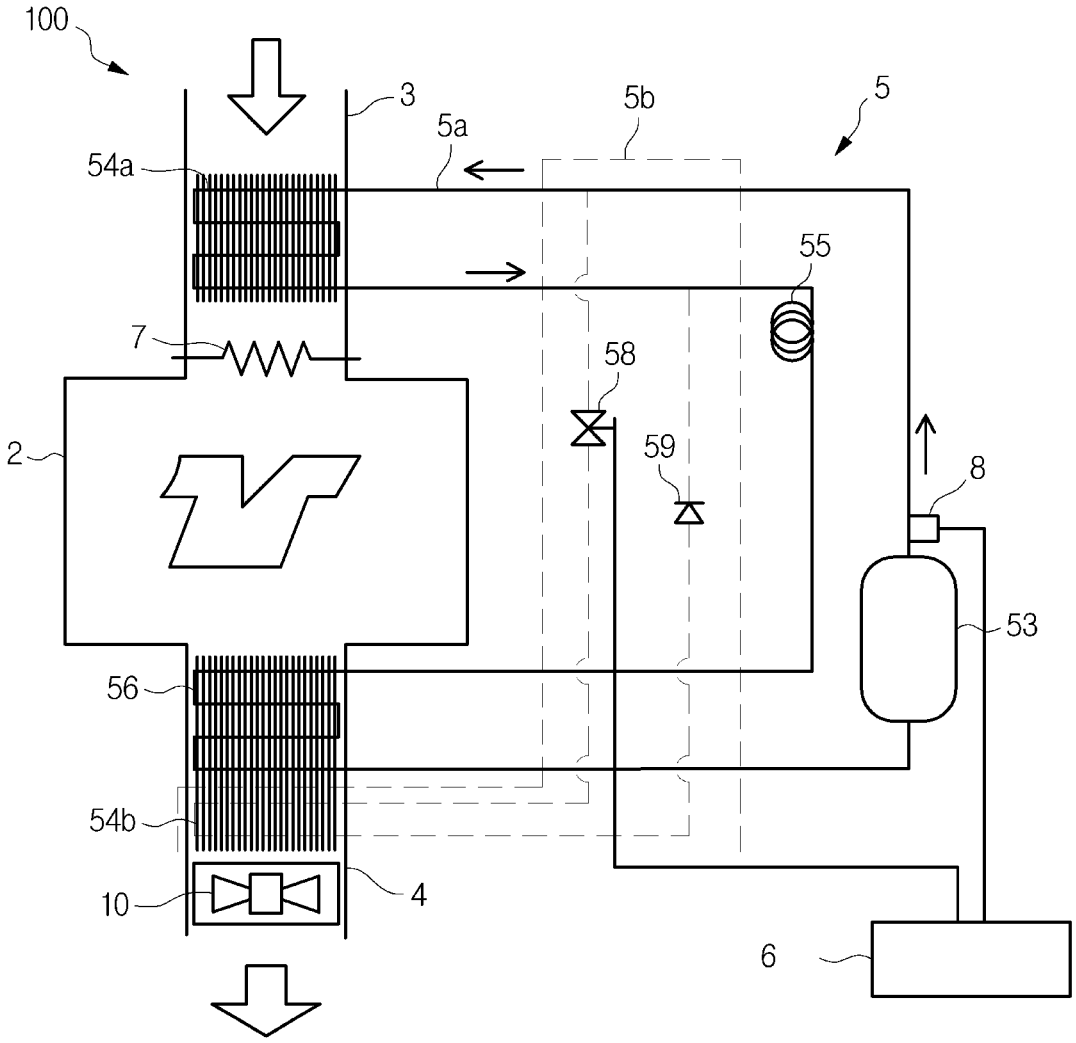
FIG. 25 is a schematic view showing a normal operation state of the clothes dryer according to the second embodiment.

First, a refrigerant flow during normal operation is shown in FIG. 25. An arrow of the drawing represents the refrigerant flow. During normal operation, the flow rate control valve 58 is closed. In the heat pump circuit 5, a refrigerant compressed to a high temperature and high pressure by the compressor 53 exchanges heat with the suctioned air through the first condenser 54*a* to heat the suctioned air. In addition, the heated suctioned air can be further heated by the heater 7 disposed downstream from the first condenser 54*a*. Next, the refrigerant decompressed to a low temperature and low pressure through the decompressor 55 exchanges heat with the exhaust air of the drum 2 through the evaporator 56 to collect heat of the exhaust air, and then returns to the compressor 53. Accordingly, the heat discharged to the outside in the related art can be collected and reused by the heat pump circuit 5.

In addition, the exhaust air cooled by the evaporator 56 flows downstream from the evaporator 56, and the second condenser 54*b* is disposed downstream from the evaporator 56. Accordingly, during normal operation, the second condenser 54*b* is cooled, and thus the sub-circuit 5*b* is also cooled. In this state, when the high pressure refrigerant is introduced into the sub-circuit 5*b* from the joining point with the main circuit, the refrigerant is liquefied and remains in the sub-circuit 5*b*, and the circulating refrigerant amount may be reduced to decrease a heat pump capacity. In the embodiment, the check valve 59 may be installed in the vicinity of the joining point of the sub-circuit 5*b* with the main circuit 5*a* to prevent the refrigerant from remaining.

Figure 26:
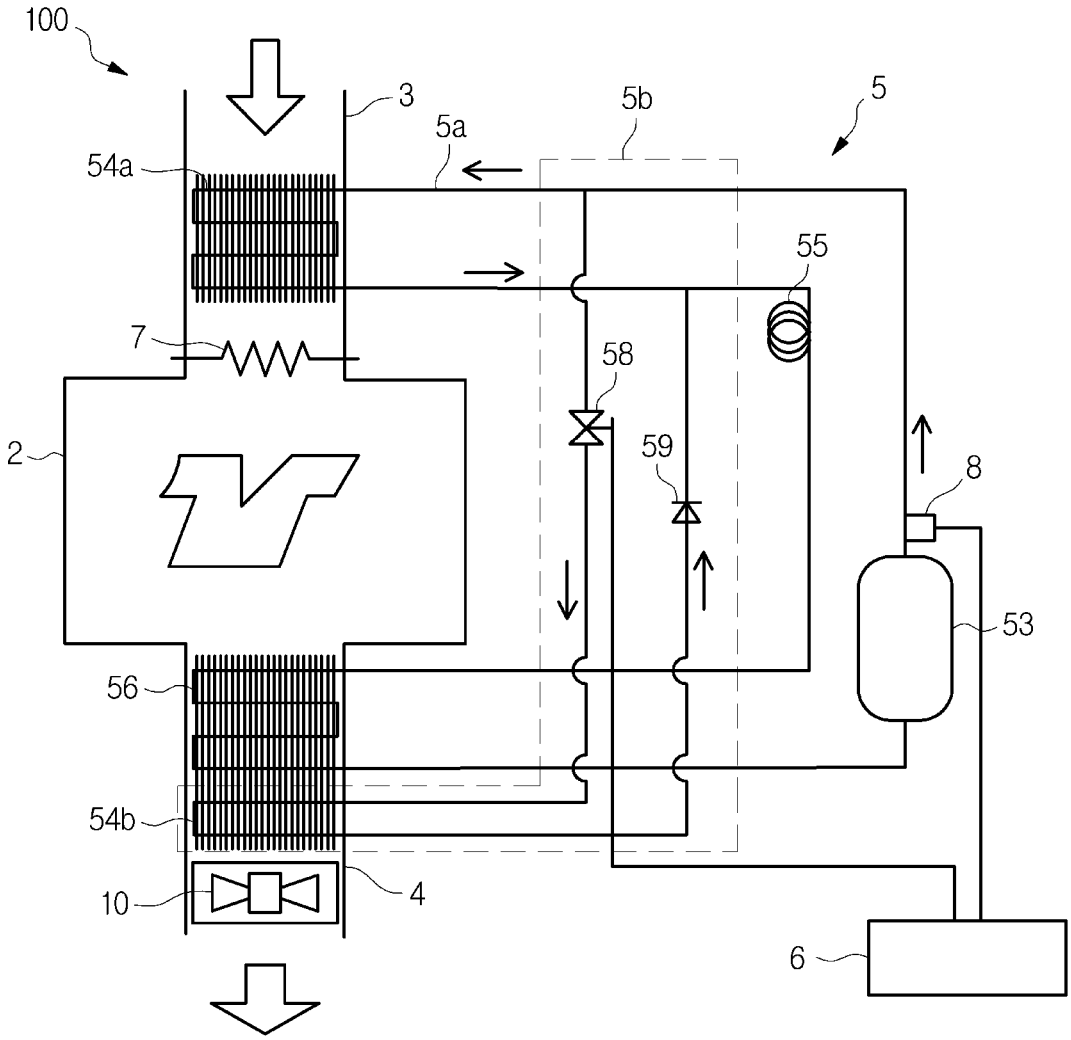
FIG. 26 is a schematic view showing an overloaded operation state of the clothes dryer according to the second embodiment.
Figure 28A:
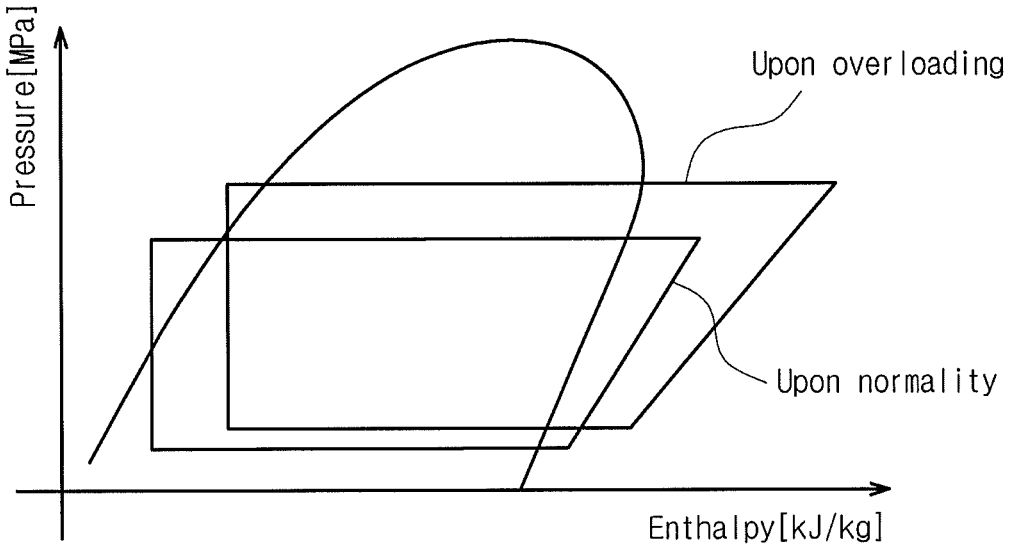
FIGS. 28A and 28B are pressure enthalpy diagrams in a heat pump circuit under an overloaded condition and after cooling under the overloaded condition.
Figure 28B:
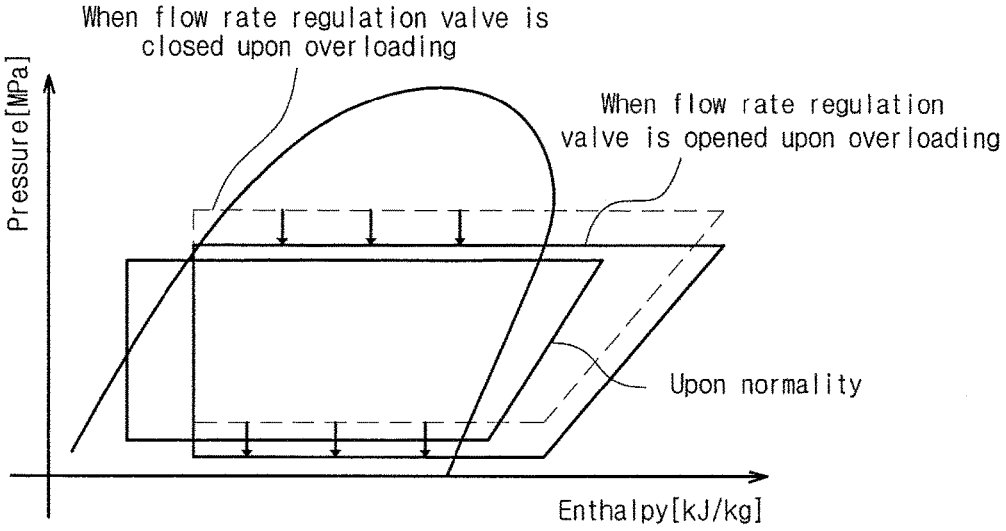

Next, a refrigerant flow under an overloaded condition such as when an external air temperature is high or a load is large is shown in FIG. 26. When the dryer is operated under the overloaded condition, as shown in FIG. 28A, in comparison with the normal operation, the refrigerant temperature is increased and the refrigerant pressure is increased. In addition, a degree of overheating of the refrigeration suctioned by the compressor 53 is also increased. Here, when the sensing unit 8 senses a refrigerant pressure of a predetermined level or more, the control unit 6 opens the flow rate control valve 58, and the high temperature high pressure refrigerant distributed by the valve opening angle at this time is also introduced into the second condenser. As a result, since the refrigerant heating value in the heat pump circuit 5 is increased and the refrigerant pressure is decreased to reduce enthalpy of the refrigerant after radiation as shown in FIG. 28B, the enthalpy of the suctioned refrigerant of the compressor 53 is reduced and the temperature of the compressor 53 is also decreased.

For example, when the kind of the refrigerant is R407C, since a use allowable range of the refrigerant pressure in the compressor 53 is limited to 3 MPa or less, the flow rate control valve 58 is controlled such that the refrigerant pressure is 3 MPa or less.

In addition, instead of the sensing unit 8 sensing the refrigerant pressure, the refrigerant temperature in the heat pump circuit 5 can be controlled using a method of sensing a refrigerant temperature using the sensing unit 8 and controlling the flow rate control valve 58 using the control unit 6 according to the sensed refrigerant temperature.

According to the clothes dryer 100 of the above-mentioned second embodiment, the sub-circuit 5*b* is provided, the second condenser 54*b* is included in the sub-circuit 5*b*, the second condenser 54*b* is installed at the exhaust flow path 4, the second condenser exchanges heat with the exhaust air, the heat of the refrigerant in the heat pump circuit 5 can be radiated, and thus overheating of the heat pump circuit 5 generated under the overloaded condition or the like can be prevented. In addition, as the flow rate control valve 58 is installed upstream from the second condenser 54*b*, the refrigerant can be cooled to correspond to the refrigerant temperature or refrigerant pressure in the heat pump circuit 5 without interfering with the radiation capacity of the first condenser during normal operation. Accordingly, the high temperature and high pressure of the refrigerant in the heat pump circuit are prevented without necessity of blowing from the exclusive blower and water cooling by the drained water with respect to the second condenser 54*b*.

Third Embodiment

Figure 27:
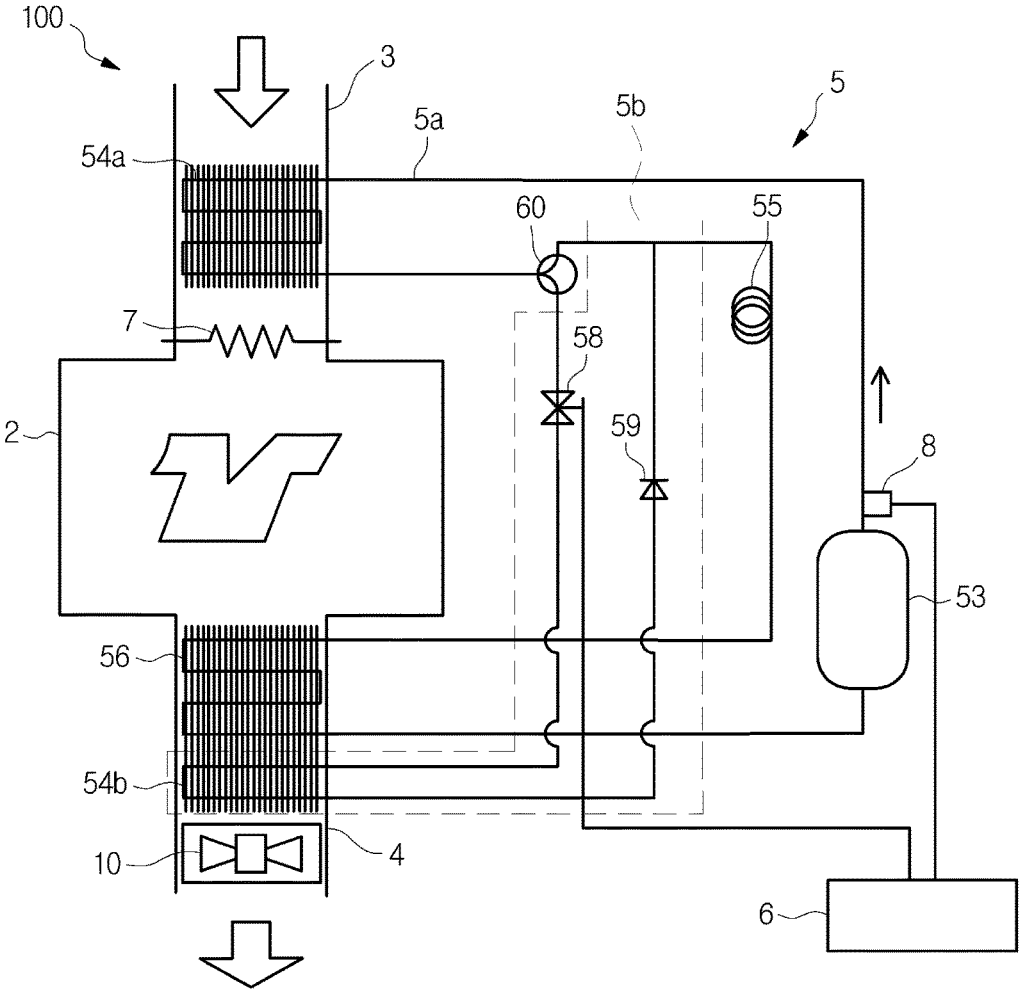
FIG. 27 is a schematic view showing a configuration of a clothes dryer according to a third embodiment.

As shown in FIG. 27, in a clothes dryer of a third embodiment, the second condenser 54*b* is branched off between the first condenser 54*a* and the decompressor 55 of the main circuit 5*a*, the sub-circuit 5*b* joining the intersection and the decompressor 55 is provided, and a circuit switching device 60 configured to branch off the sub-circuit 5*b* from the main circuit 5*a* is installed at the intersection of the heat pump circuit 5. During normal operation, when a sub-circuit-side outlet of the circuit switching device 60 is closed and the refrigerant temperature or refrigerant pressure in the heat pump circuit 5 arrives at a predetermined level or more, the sub-circuit 5*b* side of the circuit switching device 60 is opened to decrease the refrigerant temperature and refrigerant pressure in the heat pump circuit 5. Another configuration is similar to the second embodiment, and detailed description is incorporated from the second embodiment. In addition, the same reference numerals designated in FIG. 27 and FIG. 24 represent the same elements as the second embodiment.

According to the clothes dryer 100 of the above-mentioned third embodiment, the circuit switching device 60 configured to branch off the sub-circuit 5*b* from the main circuit 5*a* is installed at the intersection of the heat pump circuit 5. Accordingly, the refrigerant can be cooled in response to the refrigerant temperature or refrigerant pressure in the heat pump circuit 5 without interference with radiation capacity of the first condenser during normal operation. Accordingly, the water cooling by the exclusive blower or the drained water with respect to the second condenser 54*b* is not required, and the high temperature and high pressure of the refrigerant in the heat pump circuit is prevented.

In addition, while the flow rate control valve 58 is not always provided, fine adjustment of the refrigerant flow rate is facilitated when the flow rate control valve 58 is provided.

Other Modified Embodiments

Figure 29:
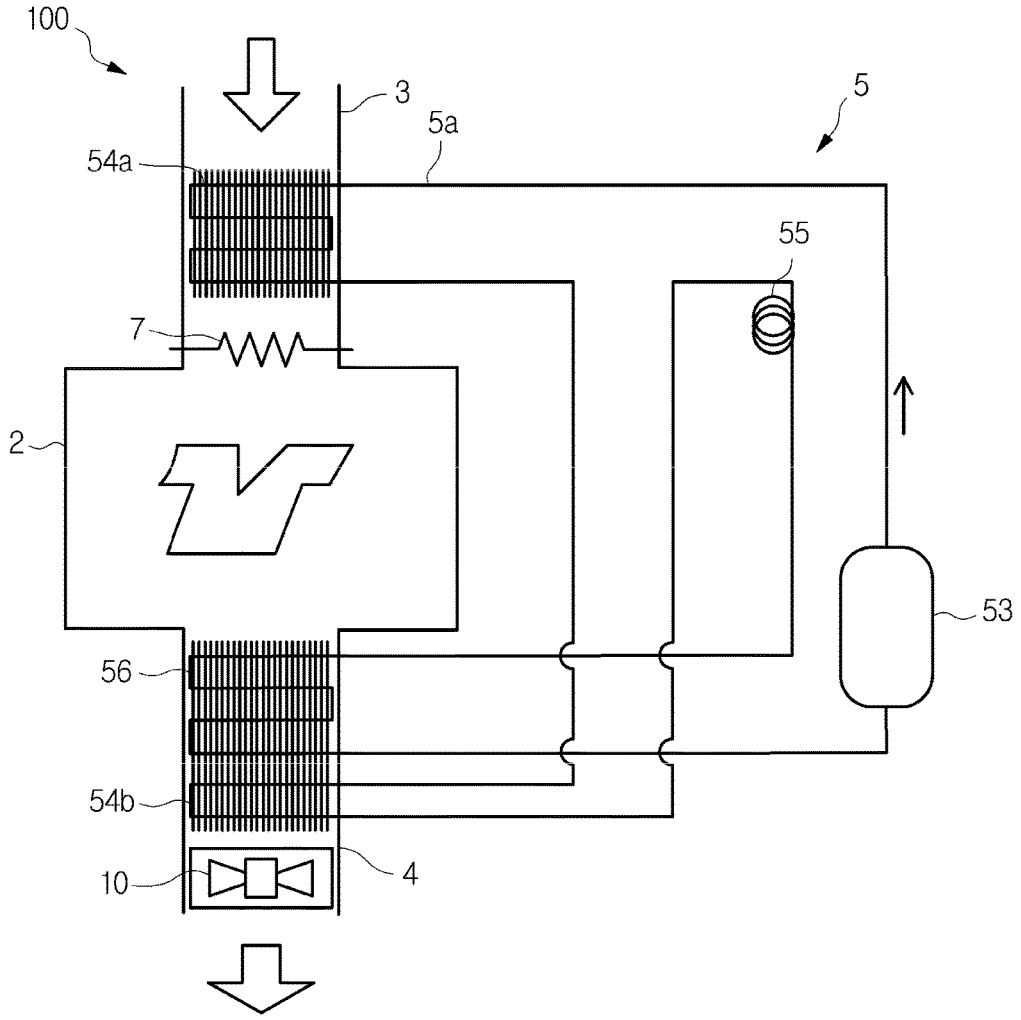
FIG. 29 is a schematic view showing a configuration of a clothes dryer according to a modified embodiment of the third embodiment.

In addition, the present invention is not limited to the embodiment. For example, as shown in FIG. 29, even when the compressor 53, the first condenser 54*a*, the second condenser 54*b*, the decompressor 55 and the evaporator 56 are serially connected in sequence, a radiation effect to the outside of the heat pump circuit 5 by the second condenser 54*b* can be obtained.

In addition, in the embodiment, even when the heater 7, the flow rate control valve 58 and the check valve 59 are not provided, the radiation effect to the outside of the heat pump circuit 5 by the second condenser 54*b* can be obtained.

In addition, even when the refrigerant flow rate regulator 58 such as the flow rate control valve or the like is disposed downstream from the second condenser 54*b* of the sub-circuit 5*b*, the refrigerant temperature and refrigerant pressure of the heat pump circuit 5 can be adjusted.

In addition, the second condenser 54*b* may be disposed at the exhaust flow path 4 upstream from the evaporator 56, or the second condenser 54*b* and the evaporator 56 may be disposed in parallel with respect to the air stream of the exhaust flow path 4.

In addition, as the second condenser 54*b* and the evaporator 56 are integrated, reduction in space and cost of the clothes dryer 100 may become possible.

In addition, while schematically shown in FIGS. 28A and 28B, in general, a line representing a pressure according to enthalpy is increased upward and rightward. Further, various setting values in the heat pump circuit 5 may be set with respect to a pressure that becomes a peak of an upward and rightward increase upon the high pressure. For this reason, the pressure sensor (the sensing unit 8) itself may be disposed in the vicinity of the outlet of the compressor 53 in principle. However, in reality, since a variation in pressure (a variation of the upward and rightward increase) is not very large, the pressure sensor may be disposed between the compressor 53 and the decompressor 55, and even in this case, predetermined measurement used for control of the above-mentioned clothes dryer is possible.

In addition, since the temperature and the pressure have correlation in the 2-phase state in which the refrigerant gas and the refrigerant liquid are mixed, instead of measurement of the refrigerant pressure using the pressure sensor, a temperature sensor may be installed to measure the refrigerant temperature to control the flow rate regulator. Here, while the refrigerant in the vicinity of the outlet of the compressor 53 is in a gaseous state, the refrigerant radiates heat to the first condenser 54*a* to be condensed to become the 2-phase state, and is entirely liquefied in the vicinity of the outlet of the first condenser 54*a* to be overcooled in a temperature-decreased state. For this reason, the temperature sensor may be generally installed near the middle of the condenser in the 2-phase state. However, in actuality, since a temperature difference due to the overcooling in the vicinity of the outlet of the first condenser 54*a* is small, even when the temperature sensor is disposed at the outlet or the like of the first condenser 54*a*, measurements required for the control of the above-mentioned clothes dryer become possible. In addition, while precision may be somewhat decreased at the outlet of the compressor 53, the same measurement becomes possible.

Moreover, the present invention is not limited to the embodiment but may be variously modified without departing from the spirit of the present invention.

Fourth Embodiment

Figure 30:
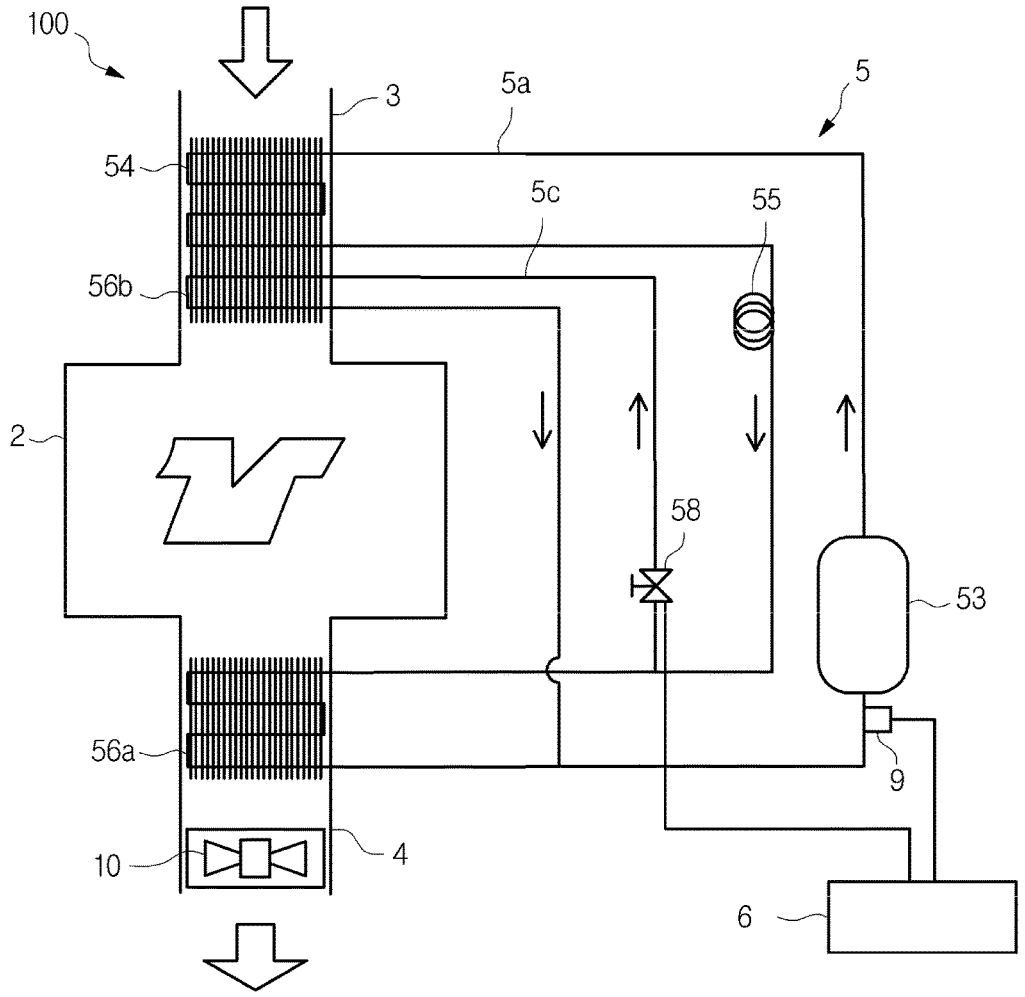
FIG. 30 is a schematic view showing an overloaded operation state of a clothes dryer according to a fourth embodiment.

The clothes dryer 100 of a fourth embodiment is an exhaust type heat pump clothes dryer, and as shown in FIG. 30, includes the drum 2 configured to accommodate clothes, the suction flow path 3 configured to suction air from the outside into the drum 2, the exhaust flow path 4 configured to exhaust the air from the drum 2 to the outside, the heat pump circuit 5 configured to heat the suctioned air in the suction flow path 3 and absorb the heat from the exhaust air in the exhaust flow path 4, and the control unit 6 configured to control the respective parts of the clothes dryer 100.

The heat pump circuit 5 has the main circuit 5*a* to which the compressor 53, the condenser 54, the decompressor 55 and the first evaporator 56*a* are sequentially connected in a loop shape, and a sub-circuit 5*c* to which the refrigerant flow rate regulator 58 and the second evaporator 56*b* branched off between the decompressor 55 and the first evaporator 56*a* of the main circuit 5*a* are sequentially connected and joining the first evaporator 56*a* and the compressor 53.

In addition, the condenser 54 and the second evaporator 56*b* are installed in the suction flow path 3 to exchange heat with the suctioned air, and the first evaporator 56*a* is installed in the exhaust flow path 4 to exchange heat with the exhaust air.

The second evaporator 56*b* is disposed in the suction flow path 3 downstream from the condenser 54. According to the disposition, the second evaporator 56*b* exchanges heat with the high temperature suctioned air heated by the condenser 54 to heat the refrigerant.

The refrigerant flow rate regulator 58 is a flow rate control valve such as a motor-operated valve, an electronic valve, or the like, and adjusts a refrigerant flow rate by varying a valve opening angle. In addition, the flow rate control valve 58 is disposed in the vicinity of an intersection of the sub-circuit 5*c* with the main circuit 5*a*.

The blower 10 configured to blow air from the inside of the drum 2 to the outside of the drum 2 is installed in the exhaust flow path 4 downstream from the first evaporator 56*a*. As the blower 10, a centrifugal fan such as a multi-blade fan, a turbo fan, or the like, having a high static pressure, is used in consideration of pressure loss of the exhaust duct.

A sensing unit 9 configured to measure a refrigerant pressure at the outlet of the first evaporator 56*a* is installed at the suction pipe (the outlet of the first evaporator 56*a*) of the compressor 53 of the heat pump circuit 5. The sensing unit 9 outputs the sensed pressure value to the control unit 6 as a pressure detection signal.

The control unit 6 is a computer having a CPU, a memory, an I/O channel, an output device such as a display or the like, an input device such as a keyboard or the like, an AD converter, and so on. As the CPU or peripheral devices thereof are operated according to a control program stored in the memory, the respective parts of the clothes dryer 100 are controlled to dry clothes.

Specifically, the control unit 6 obtains a detection signal from the sensing unit 9 to control the flow rate control valve 58 according to the refrigerant pressure represented by the detection signal, and controls the flow rate of the refrigerant introduced into the sub-circuit 5*c*, i.e., the second evaporator 56*b*.

Hereinafter, a control method of the clothes dryer 100 will be described with reference to the accompanying drawings.

Figure 31:
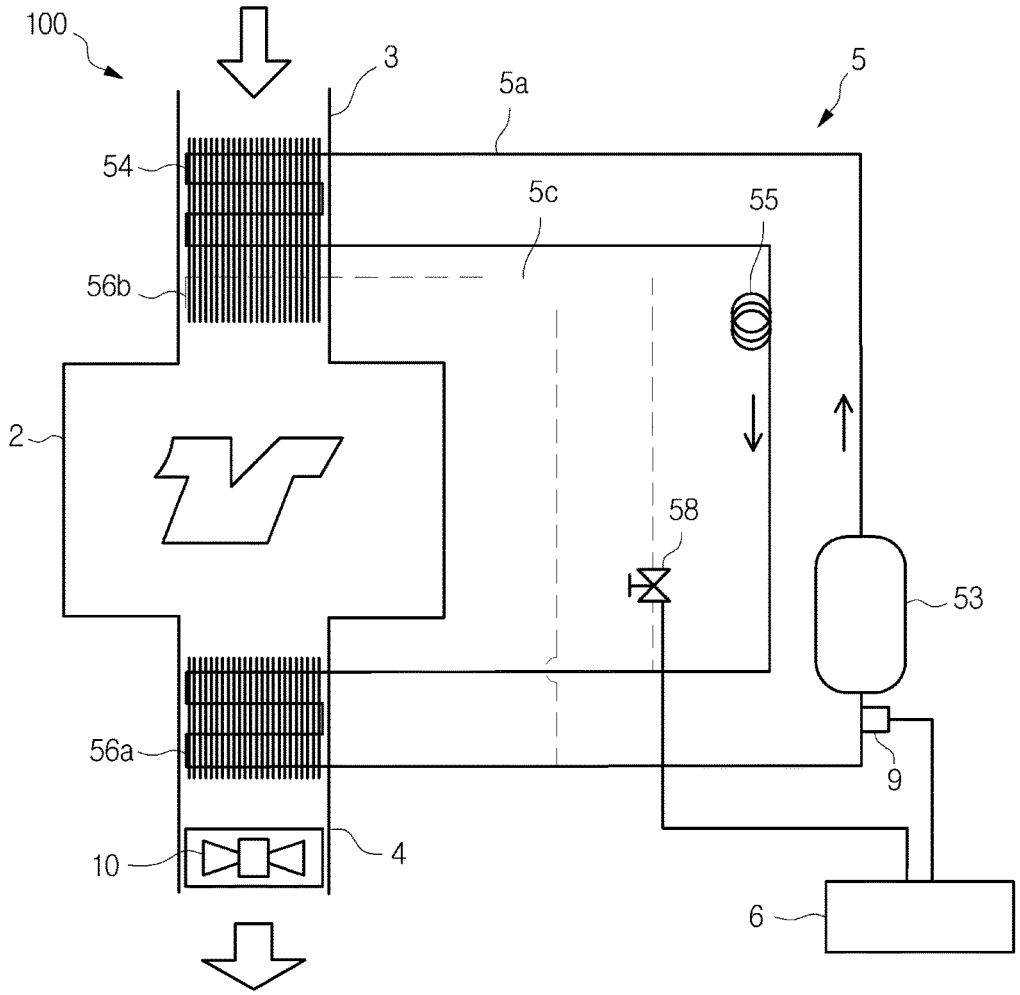
FIG. 31 is a schematic view showing a normal operation state of the clothes dryer according to the fourth embodiment.

First, a refrigerant during normal operation is shown in FIG. 31. An arrow of FIG. 31 represents the refrigerant flow. During normal operation, the flow rate control valve 58 is closed, and the refrigerant does not flow through the sub-circuit 5*c*. In the heat pump circuit 5, the refrigerant compressed to a high temperature and a high pressure by the compressor 53 exchanges heat with the suctioned air using the condenser 54 to heat the suctioned air. Next, the refrigerant decompressed to a low temperature and a low pressure by the decompressor 55 exchanges heat with the exhaust air from the drum 2 using the first evaporator 56*a* to collect the heat of the exhaust air to return to the compressor 53. The heat that is discharged to the outside in the related art can be collected by the heat pump circuit 5 to be reused.

Figure 32A:
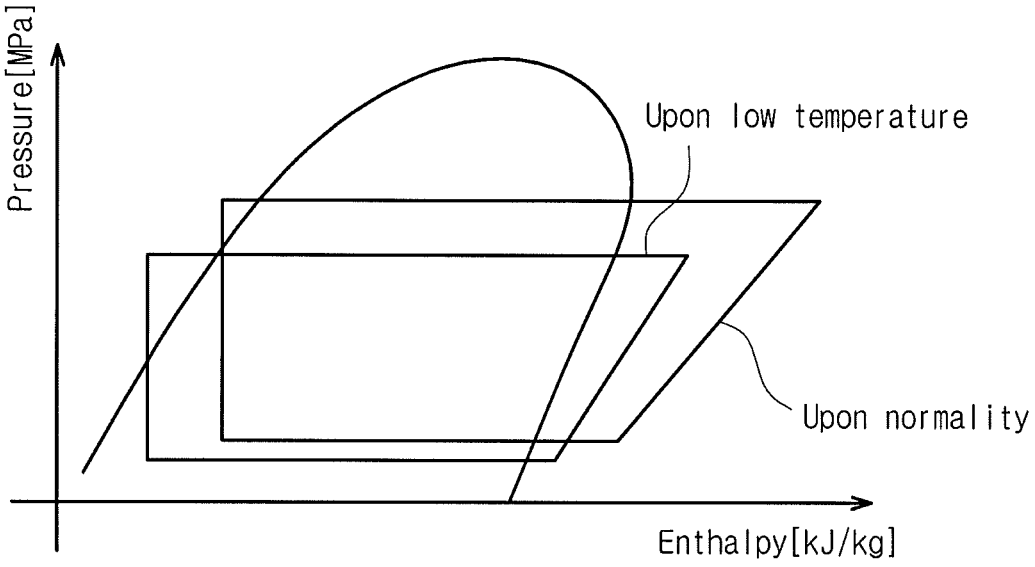
FIGS. 32A and 32B are pressure enthalpy diagrams in a heat pump circuit under a low temperature condition and after heating under the low temperature condition.
Figure 32B:
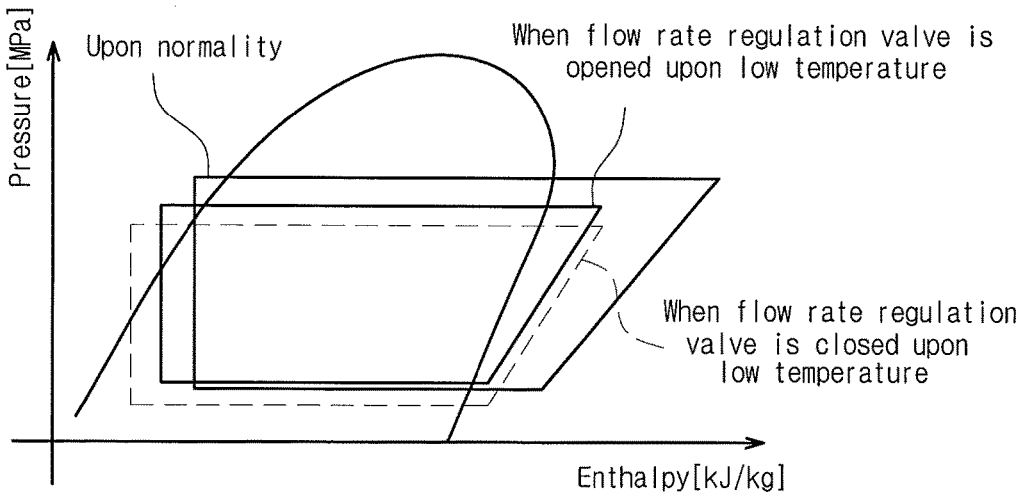

Next, when the dryer operates normally under the low temperature condition in which the external air temperature is low, as shown in FIG. 32A, the refrigerant pressure is decreased. As the refrigerant pressure is decreased, the refrigerant temperature is also decreased. Accordingly, the suctioned refrigerant pressure of the compressor 53 is also decreased. Here, when the sensing unit 9 senses the refrigerant pressure of the predetermined level or less, the control unit 6 controls the flow rate control valve 58 to open. As shown in FIG. 30, when the flow rate control valve 58 is opened, the low temperature and low pressure refrigerant distributed by the valve opening angle is introduced into the second evaporator 56*b*. Accordingly, the refrigerant temperature in the heat pump circuit 5 is increased, and thus the refrigerant pressure is increased. Accordingly, as shown in FIG. 32B, the refrigerant pressure is increased, and the enthalpy of the refrigerant after heating is increased. As the respective parts of the clothes dryer 100 are controlled as described above, the refrigerant temperature in the heat pump circuit 5 can be improved.

In addition, instead of the sensing unit 9 sensing the refrigerant pressure, the refrigerant temperature in the heat pump circuit 5 can be controlled using a method of the sensing unit 9 sensing the refrigerant temperature and the control unit 6 controlling the flow rate control valve 58 according to the sensed refrigerant temperature.

According to the clothes dryer 100 of the above-mentioned fourth embodiment, as the second evaporator 56*b* of the sub-circuit 5*c* is installed at the suction flow path 3, the second evaporator 56*b* exchanges heat with the heated suctioned air and the second evaporator 56*b* absorbs the heat, increasing the temperature of the entire refrigerant in the heat pump circuit 5. Accordingly, frosting of the refrigerant in the heat pump circuit 5 on the first evaporator 56*a* in the low temperature and low pressure state can be prevented without enhancement of the evaporator capacity or reduction in the compressor capacity and without using the variable displacement compressor. In addition, as the temperature of the entire refrigerant in the heat pump circuit 5 is increased, the temperature of the first evaporator 56*a* is increased and the air temperature exhausted to the outside is also increased. Accordingly, dew condensation on the exhaust flow path 4 (for example, the surface of the exhaust duct) can be reduced.

Fifth Embodiment

Figure 33:
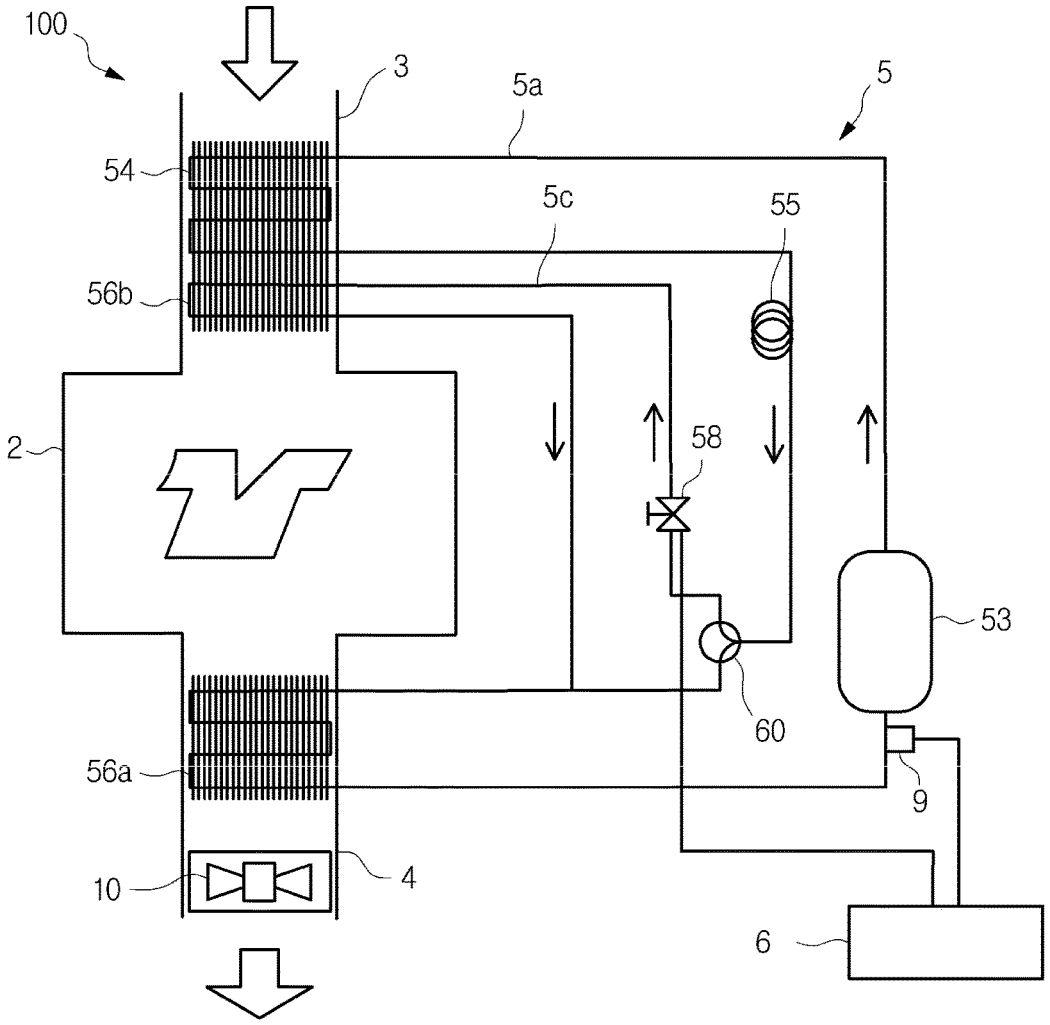
FIG. 33 is a schematic view showing a configuration of a clothes dryer according to a fifth embodiment.

In the clothes dryer 100 of a fifth embodiment, as shown in FIG. 33, the second evaporator 56*b* is installed to be branched off between the decompressor 55 and the first evaporator 56*a* of the main circuit 5*a*, the sub-circuit 5*c* joining the intersection and the first evaporator 56*a* is provided, and the circuit switching device 60 configured to branch off the sub-circuit 5*c* from the main circuit 5*a* is installed at the intersection of the heat pump circuit 5. During normal operation, when the outlet of the sub-circuit 5*c* side of the circuit switching device 60 is closed and the refrigerant temperature or refrigerant pressure in the heat pump circuit 5 is a predetermined level or less, the sub-circuit 5*c* side of the circuit switching device 60 is opened to heat the refrigerant in the heat pump circuit 5. The other configurations are the same as those of the fourth embodiment and detailed description is incorporated from the fourth embodiment. In addition, the same reference numerals of FIG. 33 and FIG. 24 represent the same configurations as in the fourth embodiment.

In the clothes dryer 100 according to the above-mentioned fifth embodiment, as the circuit switching device 60 configured to branch off the sub-circuit 5*c* from the main circuit 5*a* is installed at the intersection of the heat pump circuit 5, the refrigerant can be heated according to the refrigerant temperature and refrigerant pressure in the heat pump circuit 5 without interference with radiation capacity of the condenser 54 during normal operation.

Other Modified Embodiments

Figure 34:
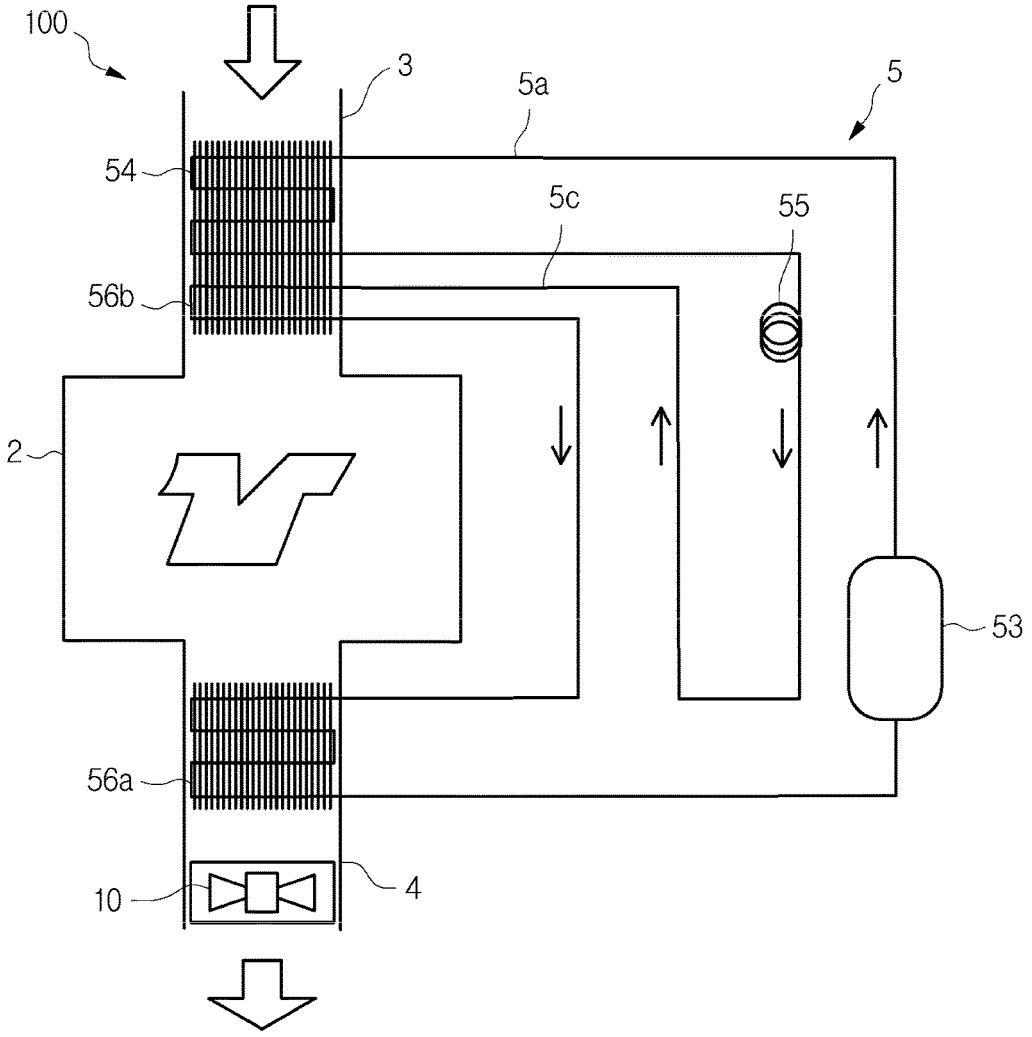
FIG. 34 is a schematic view showing a configuration of a clothes dryer according to a modified embodiment of the fourth or fifth embodiment.

In addition, the present invention is not limited to the embodiment. For example, as shown in FIG. 34, even when the compressor 53, the condenser 54, the decompressor 55, the second evaporator 56*b* and the first evaporator 56*a* are sequentially connected without providing the flow rate control valve 58, the refrigerant temperature in the heat pump circuit 5 can be increased, and freezing of the evaporator due to a decrease in refrigerant temperature can be prevented while preventing the low temperature and low pressure of the refrigerant.

In addition, the flow rate control valve 58 may be disposed in the sub-circuit 5*c* downstream from the second evaporator 56*b*, and even according to the above-mentioned configuration, the refrigerant temperature and the refrigerant pressure of the heat pump circuit 5 can be adjusted.

In addition, there is no need to dispose the second evaporator 56*b* in the suction flow path 3 downstream from the condenser 54, and for example, the second evaporator 56*b* and the condenser 54 may be installed in parallel.

In addition, as the condenser 54 and the second evaporator 56*b* are integrated, reduction in space and cost of the clothes dryer 100 becomes possible.

In addition, an auxiliary heater configured to auxiliary heat the air may be installed in the suction flow path 3 downstream from the condenser 54. Further, when the auxiliary heater is installed, the second evaporator 56*b* may be installed either upstream or downstream from the auxiliary heater.

Moreover, the present invention is not limited to the embodiment but may be variously modified without departing from the spirit of the present invention.

Sixth Embodiment

Figure 35:
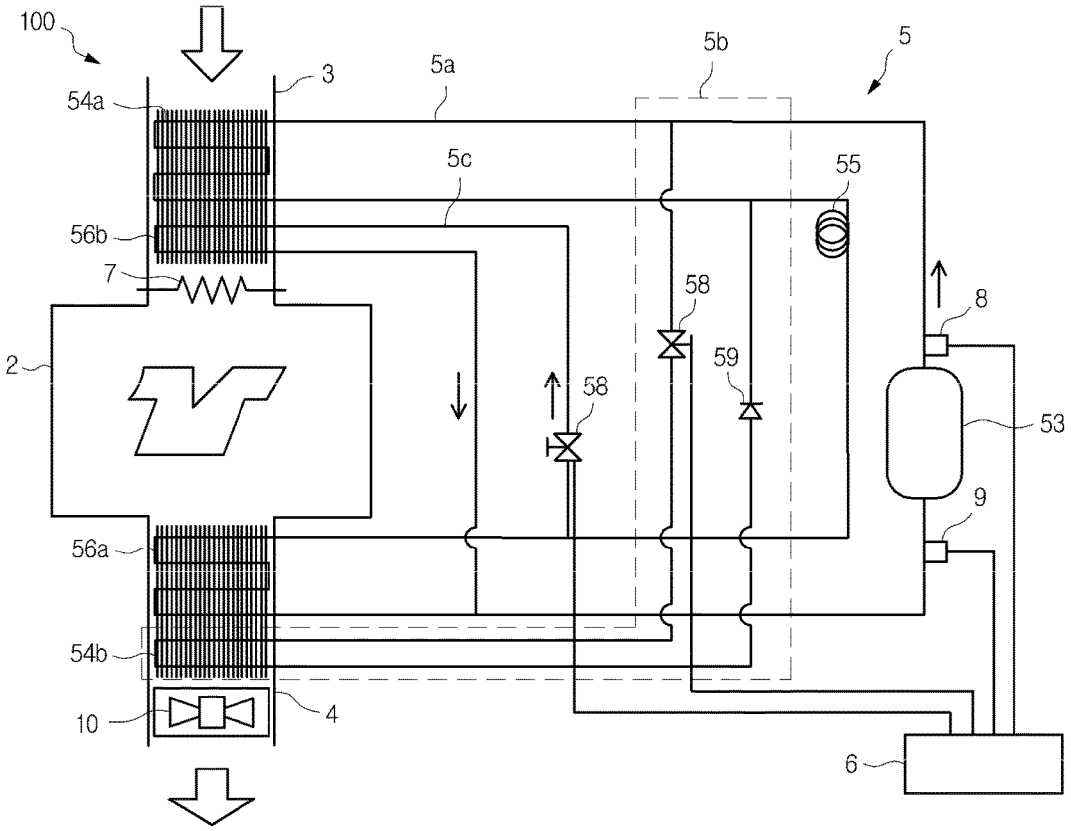
FIG. 35 is a schematic view showing a configuration of a clothes dryer according to a sixth embodiment.
Figure 36:
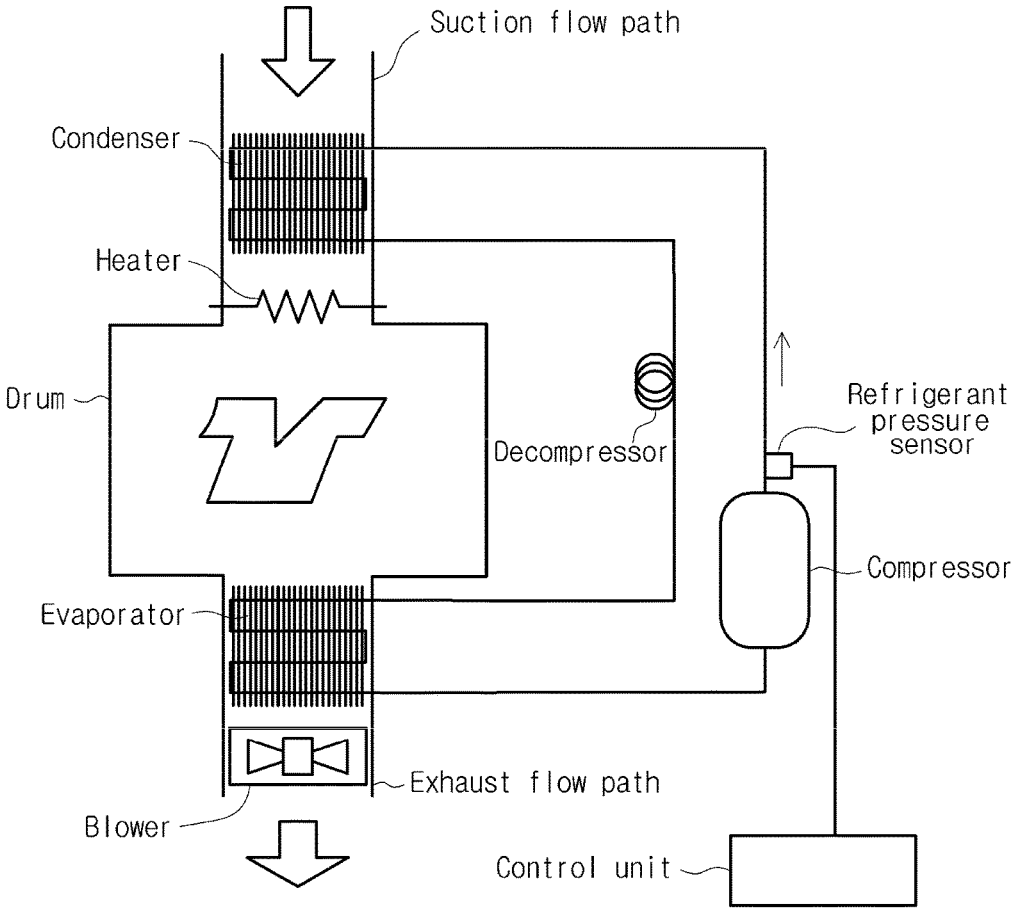
FIG. 36 is a schematic view showing a configuration of a conventional exhaust-type heat pump clothes dryer.
Figure 37:
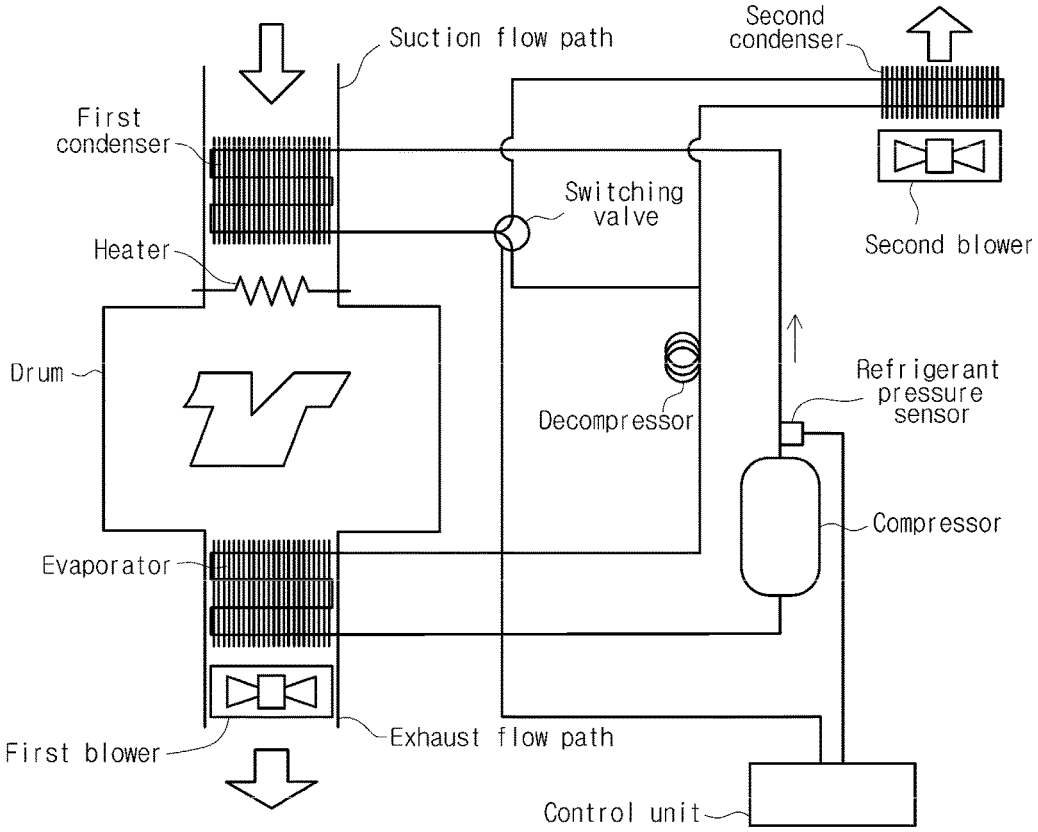
FIG. 37 is a schematic view showing a radiation unit of the conventional exhaust-type heat pump clothes dryer.

The configuration (FIG. 24) of the second embodiment and the configuration (FIG. 30) of the fourth embodiment may be combined to configure a clothes dryer shown in FIG. 35.

That is, both of the sub-circuit 5*b* of the second embodiment and the sub-circuit 5*c* of the fourth embodiment may be additionally installed at the main circuit 5*a*. Accordingly, when the refrigerant in the heat pump circuit 5 reaches a high temperature and high pressure, as described in the second embodiment, as the flow rate control valve 58 of the sub-circuit 5*b* is opened and the refrigerant also flows to the second condenser 54*b*, the high temperature and high pressure state of the refrigerant can be prevented. Simultaneously, when the refrigerant in the heat pump circuit 5 reaches a low temperature and low pressure, as described in the fourth embodiment, as the flow rate control valve 58 of the sub-circuit 5*c* and the refrigerant also flows to the second evaporator 56*b*, frosting on the first evaporator 56*a* of the refrigerant in the low temperature and low pressure state can be prevented.

In addition, similarly, the configuration (FIG. 27) of the third embodiment and the configuration (FIG. 33) of the fifth embodiment may be combined.

As is apparent from the above description, in the present invention, the flow rate of the air flowing through the clothes dryer can be precisely detected with a relatively simple configuration.

In addition, since the lint hooked by the rectification unit can be removed from the rectification unit, it is possible to prevent the lint from being hooked by the anemometer and implement the clothes dryer having good reliability.

In addition, according to the present invention having the above-mentioned configuration, as the heat is radiated from the second condenser to cool the heat pump circuit and simultaneously the amount of the refrigerant introduced into the second condenser is decreased or increased according to the refrigerant temperature or the refrigerant pressure in the heat pump circuit, the temperature and the pressure in the heat pump circuit can be optimally maintained.

In addition, according to the present invention having the above-mentioned configuration, frosting on the evaporator in the low temperature and low pressure state of the refrigerant in the heat pump circuit can be prevented without enhancement of the evaporator capacity or reduction in the compressor capacity and without using the variable displacement compressor.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A clothes dryer comprising:

a suction flow path configured to suction air into a drum of the clothes dryer;

an exhaust flow path configured to exhaust the suctioned air in the drum;

a heat pump circuit comprising a heat exchanger provided in at least one of the suction flow path and the exhaust flow path, and a refrigerant pipe; and a flow velocity sensor comprising a hot thermistor and a temperature compensation thermistor, the hot thermistor and the temperature compensation thermistor at a substantially same height to each other, in parallel to a surface of the refrigerant pipe, and installed within a cylindrical protection ring downstream from the heat exchanger to detect a flow velocity of the exhausted air.

2. The clothes dryer according to claim 1, wherein the hot thermistor and the temperature compensation thermistor are provided such that a height position error (T) is ½ or less of a pitch (A) of the refrigerant pipe.

3. The clothes dryer according to claim 1, further comprising a detection unit configured to detect clogging of a filter based on the detected flow velocity of the exhausted air.

4. The clothes dryer according to claim 1, wherein the heat pump circuit further comprises a compressor and a decompressor, and the heat exchanger comprises a first evaporator provided at the exhaust flow path, and a second evaporator and a condenser provided at the suction flow path.

5. The clothes dryer according to claim 4, wherein the heat pump circuit comprises a main circuit to which the compressor, the condenser, the decompressor and the first evaporator are serially connected in sequence, and a sub-circuit comprising a second evaporator connected to the first evaporator in parallel.

6. The clothes dryer according to claim 5, wherein the sub-circuit is branched off between the first evaporator and the compressor of the main circuit to provide the second evaporator, and joins the first evaporator and the decompressor, and the sub-circuit further comprises a refrigerant flow rate regulator provided upstream from the second evaporator.

7. The clothes dryer according to claim 6, further comprising:

a sensing unit configured to sense a pressure and a temperature of the refrigerant downstream from the compressor; and a control unit configured to control at least one of the refrigerant flow rate regulator and the circuit switching device and increase an amount of the refrigerant introduced into the second evaporator when the sensed pressure and temperature of the refrigerant is a predetermined level or less.

8. The clothes dryer according to claim 5, wherein the sub-circuit is branched off between the first evaporator and the decompressor of the main circuit to provide the second evaporator, and joins the intersection and the decompressor, and the sub-circuit further comprises a circuit switching device provided at the intersection and configured to branch off the sub-circuit from the main circuit.

9. The clothes dryer according to claim 8, further comprising:

a sensing unit configured to sense a pressure and a temperature of the refrigerant downstream from the compressor; and a control unit configured to control at least one of the refrigerant flow rate regulator and the circuit switching device and increase an amount of the refrigerant introduced into the second evaporator when the sensed pressure and temperature of the refrigerant is a predetermined level or less.

10. The clothes dryer according to claim 1, wherein the heat pump circuit further comprises a compressor and a decompressor, and the heat exchanger comprises a first condenser and a second evaporator provided at the suction flow path, and a second condenser and a first evaporator provided at the exhaust flow path.

11. A clothes dryer comprising:

a suction flow path configured to suction air into a drum of the clothes dryer;

an exhaust flow path configured to exhaust the suctioned air in the drum;

a heat pump circuit comprising a heat exchanger provided in at least one of the suction flow path and the exhaust flow path, and a refrigerant pipe; and a flow velocity sensor comprising a hot thermistor and a temperature compensation thermistor provided that are in parallel to a surface of the refrigerant pipe and installed downstream from the heat exchanger to detect a flow velocity of the exhausted air, wherein the flow velocity sensor comprises a cylindrical rectification unit, a sensor unit protruding toward an inside of the cylindrical rectification unit, and a slit formed in the cylindrical rectification unit in a direction of flow of the exhausted air to divide the rectification unit.

12. The clothes dryer according to claim 11, wherein the flow velocity sensor further comprises a base section configured to support the cylindrical rectification unit and the sensor unit and formed at a position opposite to the slit.

13. The clothes dryer according to claim 12, wherein a periphery of an upwind side of the cylindrical rectification unit is inclined toward a downwind side from the base section to the slit.

14. The clothes dryer according to claim 12, wherein the sensor unit is inclined toward a downwind side from a portion in contact with the base section to a protrusion end.

15. The clothes dryer according to claim 12, wherein the base section comprises a guide surface inclined toward the downwind side from a mounting portion of the upwind side of the base section to the rectification unit.

16. The clothes dryer according to claim 11, wherein a width of the slit is reduced from an upwind side toward a downwind side.

17. A clothes dryer comprising:

a suction flow path configured to suction air into a drum of the clothes dryer;

an exhaust flow path configured to exhaust the suctioned air in the drum;

a heat pump circuit comprising a heat exchanger provided in at least one of the suction flow path and the exhaust flow path, and a refrigerant pipe; and a flow velocity sensor comprising a hot thermistor and a temperature compensation thermistor that are provided in parallel to a side surface of the refrigerant pipe and installed downstream from the heat exchanger to detect a flow velocity of the exhausted air, wherein the heat pump circuit further comprises a compressor and a decompressor, and the heat exchanger comprises a first condenser provided at the suction flow path, and a second condenser and an evaporator provided at the exhaust flow path.

18. The clothes dryer according to claim 17, wherein the heat pump circuit comprises a main circuit to which the compressor, the first condenser, the decompressor and the evaporator are serially connected in sequence, and a sub-circuit comprising a second condenser connected to the first condenser in parallel.

19. The clothes dryer according to claim 18, wherein the sub-circuit is branched off between the first condenser and the compressor of the main circuit to provide the second condenser, and joins the first condenser and the decompressor, and the sub-circuit further comprises a refrigerant flow rate regulator provided upstream from the second condenser.

20. The clothes dryer according to claim 19, further comprising:

a sensing unit configured to sense a pressure and a temperature of the refrigerant between the decompressor and the compressor; and a control unit configured to control at least one of the refrigerant flow rate regulator and the circuit switching device and increase an amount of the refrigerant introduced into the second condenser when the sensed pressure and temperature of the refrigerant is a predetermined level or more.

21. The clothes dryer according to claim 18, wherein the sub-circuit is branched off between the first condenser and the decompressor of the main circuit to provide the second condenser, and joins the intersection and the decompressor, and the sub-circuit further comprises a circuit switching device provided at the intersection and configured to branch off the sub-circuit from the main circuit.

22. The clothes dryer according to claim 21, further comprising:

a sensing unit configured to sense a pressure and a temperature of the refrigerant between the decompressor and the compressor; and a control unit configured to control at least one of the refrigerant flow rate regulator and the circuit switching device and increase an amount of the refrigerant introduced into the second condenser when the sensed pressure and temperature of the refrigerant is a predetermined level or more.

* * * * *